US007459043B2

(12) United States Patent
Blau et al.

(10) Patent No.: US 7,459,043 B2
(45) Date of Patent: Dec. 2, 2008

(54) MOISTURE-RESISTANT BLACK POWDER SUBSTITUTE COMPOSITIONS

(75) Inventors: Reed J. Blau, Richmond, UT (US); Ruth A. Schaefer, North Ogden, UT (US); Marlin Bodily, Brigham City, UT (US); Gary Chen, Succasunna, NJ (US)

(73) Assignee: Alliant Techsystems Inc., Edina, MN (US)

( * ) Notice: Subject to any disclaimer, the term of this patent is extended or adjusted under 35 U.S.C. 154(b) by 336 days.

(21) Appl. No.: 10/631,545

(22) Filed: Jul. 31, 2003

(65) Prior Publication Data

US 2005/0072501 A1 Apr. 7, 2005

Related U.S. Application Data

(63) Continuation-in-part of application No. 10/046,008, filed on Jan. 11, 2002.

(60) Provisional application No. 60/261,111, filed on Jan. 12, 2001.

(51) Int. Cl.
*C06B 43/00* (2006.01)

(52) U.S. Cl. ..... 149/109.4; 149/77; 149/2

(58) Field of Classification Search ..... 149/2, 149/77, 109.4

See application file for complete search history.

(56) References Cited

U.S. PATENT DOCUMENTS 2,441,248 A * 5/1948 Morris et al. ..... 102/277.1
3,026,674 A * 3/1962 Haymes et al. ..... 60/255
3,293,056 A * 12/1966 Baker ..... 106/170.15
3,388,554 A * 6/1968 Hodgson ..... 60/217
3,728,173 A * 4/1973 Cook et al. ..... 149/21
3,770,524 A 11/1973 Walker et al.
3,862,866 A 1/1975 Timmerman et al.
3,902,934 A 9/1975 Timmerman
4,047,987 A 9/1977 Kusakabe et al.
4,128,443 A 12/1978 Pawlak et al.
4,238,253 A 12/1980 Garner
4,570,540 A 2/1986 Bell
H72 H 6/1986 Wise et al.
4,915,755 A 4/1990 Kim (Continued)

FOREIGN PATENT DOCUMENTS

CN 1438467 A * 8/2003

(Continued)

OTHER PUBLICATIONS

Wise et al., "SH72: Organic Substitutes for Charcoal in Black Powder", Jun. 3, 1986, pp. 1-7, Washington, D.C., U.S.A.

(Continued)

*Primary Examiner*—Jeffrey L. Gellner
(74) *Attorney, Agent, or Firm*—TraskBritt

(57) ABSTRACT

A solid pyrotechnic composition having a flame temperature and exhibiting ballistic performance comparable to that of black powder, but which does not contain charcoal or sulfur, is provided, as is a method for making such composition. A solid pyrotechnic composition, and method for making the same, which has a flame temperature and exhibits ballistic performance comparable to that of boron/potassium nitrate and that is preferably free of boron is also provided.

24 Claims, 9 Drawing Sheets

U.S. PATENT DOCUMENTS

| | | | | |
|---|---|---|---|---|
| 5,034,073 | A | 7/1991 | Barry et al. | |
| 5,320,691 | A | 6/1994 | Weber | |
| 5,425,310 | A | 6/1995 | Weber | |
| 5,449,423 | A | 9/1995 | Cioffe | |
| 5,569,875 | A | 10/1996 | Fey | |
| 5,592,812 | A | 1/1997 | Hinshaw et al. | |
| 5,633,476 | A | 5/1997 | Cioffe | |
| 5,670,098 | A | 9/1997 | Dillehay et al. | |
| 5,673,935 | A | 10/1997 | Hinshaw et al. | |
| 5,725,699 | A | 3/1998 | Hinshaw et al. | |
| 5,726,378 | A | 3/1998 | Barrett | |
| 5,731,540 | A | 3/1998 | Flanigan et al. | |
| 5,735,118 | A | 4/1998 | Hinshaw et al. | |
| 5,756,929 | A | 5/1998 | Lundstrom et al. | |
| 5,917,146 | A | 6/1999 | Hiskey et al. | |
| 6,045,638 | A | 4/2000 | Lundstrom | |
| 6,093,269 | A | 7/2000 | Lundstrom et al. | |
| 6,221,187 | B1 | 4/2001 | Knowlton et al. | |
| 6,312,537 | B1 | 11/2001 | Hiskey et al. | |
| 6,361,719 | B1 * | 3/2002 | Dillehay et al. | 264/3.3 |

FOREIGN PATENT DOCUMENTS

| | | | |
|---|---|---|---|
| DE | 840 821 | | 6/1952 |
| DE | 198 40 993 | A1 | 3/2000 |
| GB | 1 601 392 | | 10/1981 |
| WO | WO90/15788 | | 12/1990 |
| WO | WO 94/08918 | | 4/1994 |
| WO | WO98/42460 | | 10/1998 |
| WO | WO 98/42640 | | 10/1998 |

OTHER PUBLICATIONS

Invitation to Pay Additional Fees from the International Searching Authority, with attached Communication Relating to the Results of the Partial International Search, for PCT/US 02/21566.

Hawley, Gessner G., "The Condensed Chemical Dictionary," Van Nostrand Reinhold Company, pp. 77, 249, 346, 617, 813.

ISO-13320-1: 1999(E) "Particle Size Analysis-Laser Diffraction Method."

PCT International Search Report, dated Jan. 16, 2004, 7 pages.

Hussain, G., et al., "Effect of Addition of NH4CI04, KC1O4 and NH4NO3 to KNO3 Based Ternary Mixtures," J. Thermal Anal., vol. 39 (1993), pp. 1403-1415, 1993.

* cited by examiner

MOISTURE-RESISTANT BLACK POWDER SUBSTITUTE COMPOSITIONS

CROSS REFERENCE TO RELATED APPLICATIONS

This application is a continuation-in-part and claims the benefit of priority of U.S. patent application Ser. No. 10/046,008, filed on Jan. 11, 2002, pending, which itself claims the benefit of priority of U.S. Provisional Application No. 60/261,111 filed on Jan. 12, 2001.

GOVERNMENT LICENSE RIGHTS

The United States Government may have certain rights in the present invention pursuant to Contract No. DAAE30-01-C-1115 between PM Mortars (U.S. Army) and ATK Thiokol Corporation (now Alliant Techsystems Inc.).

BACKGROUND OF THE INVENTION

1. Field of the Invention

The present invention is directed to solid pyrotechnic compositions and methods for making the same, including novel black powder substitute and boron/potassium nitrate substitute compositions. More particularly, the present invention is directed to solid pyrotechnic compositions, and methods for making the same, which compositions have increased moisture resistance (measured in terms of humidity uptake) in comparison to black powder and boron/potassium nitrate compositions.

2. State of the Art

Black powder and boron/potassium nitrate ($B/KNO_3$) are conventional igniter formulations with broad current usage in a wide variety of military applications. For instance, black powder and $B/KNO_3$ are important components in ignition, propulsion and expulsion trains of many modern military weapons systems. Additionally, black powder is commonly used in commercial applications such as muzzle loading rifles, fireworks and model rocket propulsion systems, whereas $B/KNO_3$ is commonly used in the ignition trains of automotive restraint systems.

Black powder is typically comprised of between 72 and 75 weight percent potassium nitrate, between 15 and 18 weight percent charcoal and 10 weight percent sulfur. Variations in this basic black powder formulation are known to those of ordinary skill in the art. The optimum formulation for black powder is generally accepted to consist of 75 weight percent potassium nitrate, 15 weight percent charcoal and 10 weight percent sulfur. Black powder of this optimum formulation has a predicted flame temperature of about 1950K at 1000 psi.

Boron/potassium nitrate, on the other hand, in its optimum formulation, is generally accepted to consist of 75 weight percent potassium nitrate and 25 weight percent boron. Compared to black powder, $B/KNO_3$ has a significantly higher flame temperature of about 3034K at 1000 psi.

As the flame temperatures of black powder and $B/KNO_3$ differ significantly, the applications in which these igniter compositions are used differ somewhat. Black powder is by far the less expensive of the two compositions, has a cooler flame temperature and produces less slag than $B/KNO_3$. For these reasons, black powder is often chosen over $B/KNO_3$ in the ignition trains of multiple-use hardware, including guns of various sizes and applications. Boron/potassium nitrate is typically utilized in applications where a higher flame temperature is critical for rapid and reproducible ignition. For example, common applications for $B/KNO_3$ include ignition trains for rockets, decoy flares and gas generators of automotive secondary safety restraints or "air bag" devices. Boron/potassium nitrate is not, however, used as often in multiuse hardware due to the expense of $B/KNO_3$ and the high $B/KNO_3$ flame temperature, which may cause premature erosion of reusable hardware.

Processes are known to those of ordinary skill in the art for making black powder. For example, charcoal and sulfur may be ball milled together into an intimate mixture. Ball milling also serves to reduce the particle size of the charcoal and sulfur. Potassium nitrate is dried and likewise processed through a rod mill to reduce the average particle size to about 50 microns. The milled charcoal, sulfur and potassium nitrate are then compounded, milled, and optionally coated with graphite, in accordance with well-known methods.

Despite its widespread use, certain characteristics of black powder make it highly desirable to replace it in some (or all) of its common applications. For example, safety is a major concern during black powder production. Further, the combustion of black powder produces a plethora of effluents. It has been calculated that the black powder combustion generates significant amounts of carbon monoxide, sulfur dioxide and hydrogen sulfide. Potassium sulfide has been predicted to constitute over 20 percent of the combustion products. At flame temperature, potassium sulfide is produced in the liquid state and is likely to undergo after-burning with atmospheric oxygen to produce copious amounts of sulfur dioxide. The carbon monoxide and hydrogen sulfide are also susceptible to after-burning, yielding carbon dioxide and sulfur dioxide, respectively.

Sulfur dioxide is extremely destructive to tissue of the mucous membranes and upper respiratory tract, eyes and skin Inhalation may result in spasm, inflammation and edema of the larynx and bronchi, chemical pneumonitis and pulmonary edema. Thus, exposure to sulfur dioxide can lead to a series of health problems and, in the case of extended exposure, death.

Another concerning characteristic of black powder is its reproducibility. The charcoal constituent of black powder imparts a degree of unpredictability to the performance of the igniter composition. Charcoal is produced by carbonization of wood. As described in U.S. Pat. No. 5,320,691 to Weber, the chemical and physical properties of wood vary greatly, depending upon the particular properties of the tree species, soil composition and environmental conditions from which the wood is taken. Due to the inherent variability of wood and fluctuations in the carbonization process, the properties of charcoal tend to vary from batch to batch. These variations can effect the consistency of black powder performance.

Yet another problem associated with black powder is its hygroscopicity. Black powder absorbs about 1.5 weight percent moisture under 75 percent relative humidity at a temperature of 21.1° C. (70° F.) over a period of 24 hours. If black powder picks up sufficient moisture, there is a possibility that the black powder will not burn as fast. Hence, an igniter or other device comprising the black powder might not perform up to specification in a high relative humidity. Also, concerns have been expressed that water will cause the potassium nitrate to migrate out of the black powder pellet and cause corrosion of metallic parts of the device.

In light of the above-described concerns, there is a continuing need in the pyrotechnic industry for black powder substitutes which are safer to produce, more predictable and less hygroscopic than black powder. One black powder substitute composition is described in U.S. Pat. No. 5,320,691 to Weber. This composition is a dispersion of phenolphthalein, potassium nitrate and sulfur in a binding phase of phenolphthalein salt. Phenolphthalein is the reaction product of a phenolic compound and phthalic anhydride. The cations of the phenolphthalein salt are selected from the group consisting of sodium, potassium, lithium and ammonium. Phenolphthalein salt (optionally in combination with organic phenolphthalein) is used because of the ballistic enhancement that the phenolphthalein salt imparts in comparison to organic phenolphthalein. Although the substitution of phenolphthalein salt for charcoal obviates the predictability problems raised by the charcoal of the conventional black powder composition, sulfur remains as a requisite ingredient of this substitute composition. Thus, the black powder substitute of U.S. Pat. No. 5,320,691 does not address the above-mentioned problems associated with sulfur and sulfur dioxide production. Also, phenolphthalein salts are hygroscopic and do not overcome concerns regarding moisture uptake.

Another black powder substitute is described in United States Patent & Trademark Office Disclosure Document H72 to Wise, et al. The solid pyrotechnic composition described therein contains 75 weight percent potassium nitrate, 10 weight percent elemental sulfur and 15 weight percent crystalline compound. The crystalline compound may be fluorescein, phenolphthalein, 1,5-naphthalenediol, anthraflavic acid, terephthalic acid and alkali metal salts thereof. As in the case of other known black powder substitute compositions, the substitute composition described in Disclosure Document H72 relies on elemental sulfur for minimizing the ignition delay of the igniter and, thus, does not address concerns regarding sulfur and sulfur dioxide production.

Accordingly, the inventors of the present invention have recognized that alternative substitute compositions for black powder and boron/potassium nitrate, and methods for making such compositions, would be advantageous.

BRIEF SUMMARY OF THE INVENTION

The present invention provides a solid pyrotechnic composition having a flame temperature and exhibiting ballistic performance comparable to that of black powder, but which preferably (but not necessarily) does not contain charcoal or sulfur.

In accordance with one aspect of the invention, a solid pyrotechnic composition constituting a black powder substitute is provided. The composition comprises about 40.0 weight percent to about 90.0 weight percent oxidizer particles having a mean particle size of not greater than about 30 microns. The oxidizer particles comprise at least one member selected from the group consisting of alkali metal nitrate and ammonium nitrate and at least one member selected from the group consisting of alkali metal perchlorate and ammonium perchlorate. The preferred alkali metal is potassium. The solid pyrotechnic composition further comprises organic crystalline particles and, optionally, salts of organic crystalline particles. The organic crystalline particles, and the optional salts thereof, preferably have a mean particle size of not greater than about 30 microns and preferably account for about 10.0 weight percent to about 60.0 weight percent of the total weight of the solid pyrotechnic composition. The organic crystalline particles preferably comprise phenolphthalein.

The present invention, according to a second aspect, provides a solid pyrotechnic composition that has a flame temperature and exhibits ballistic performance comparable to that of boron/potassium nitrate and that is preferably (although not necessarily) free of boron.

In accordance with this second aspect of the invention, a solid pyrotechnic composition comprising a boron/potassium nitrate substitute is provided. The composition comprises about 40.0 weight percent to about 90.0 weight percent oxidizer particles having a mean particle size of not greater than about 30 microns. The oxidizer particles comprise at least one member selected from the group consisting of alkali metal perchlorate and ammonium perchlorate. The perchlorate particles make up from about 20.0 weight percent to about 90.0 weight percent of the total weight of the composition, and more preferably about 30.0 weight percent to about 90.0 weight percent of the total weight of the composition. The oxidizer particles may also comprise other materials including, but not limited to, at least one member selected from the group consisting of alkali metal nitrate and ammonium nitrate. The preferred alkali metal for the perchlorate and nitrate is potassium. The solid pyrotechnic composition further comprises organic crystalline particles and, optionally, salts of organic crystalline particles. The organic crystalline particles, and the optional salts thereof, preferably have a mean particle size of not greater than about 30 microns and preferably account for about 10.0 weight percent to about 60.0 weight percent of the total weight of the solid pyrotechnic composition. The organic crystalline particles are preferably phenolphthalein.

In their respective embodiments, the selection of the constituents of these novel black powder substitute and boron/potassium nitrate substitute compositions can significantly reduce the production of harmful effluents derived from sulfur. In this way, the invention may provide a reduction in the environmental impact and worker health risks encountered during firing and conducting post-fire clean-up operations of articles using the compositions. Additionally, the solid pyrotechnic compositions according to the currently preferred embodiments of the present invention may possess excellent impact and thermal sensitivities, thereby reducing the incipient hazards of the igniter to detonation and premature ignition via response to stimuli such as impact, friction, heat and/or electrostatic discharge. Further, the use of organic crystalline compounds in lieu of (or partial lieu of) crystalline salts, as well as the use of nonhygroscopic binders, can significantly lower the moisture uptake or absorption of the inventive solid pyrotechnic composition in comparison to black powder. Still further, the omission of charcoal from the currently preferred embodiments of the invention can improve upon the reproducibility and uniformity of the ballistic properties of the pyrotechnic compositions, as well as minimize the moisture uptake of the compositions. Further still, by finely grinding the organic crystalline compounds as well as the oxidizers before mixing, ignitability and ballistic performance may be improved significantly. Additionally, the brisance of the composition may be varied over a broad range by changing the ratio of potassium perchlorate to potassium nitrate. Higher levels of potassium perchlorate increase the brisance of the composition.

The present invention, according to a third aspect, provides a novel method of making black powder substitute and boron/potassium nitrate substitute compositions. The method comprises combining an alkali metal hydroxide with at least one organic crystalline compound to produce a solution comprising a salt of the organic crystalline compound. The organic crystalline compound is preferably selected from the group consisting of phenolphthalein and a compound derived from the reaction between a phenolic compound and phthalic anhydride. The solution is then combined with at least one acid selected from the group consisting of nitric acid and perchloric acid. The alkali metal hydroxide reacts with the nitric acid or perchloric acid to form alkali metal nitrate particles or alkali metal perchlorate particles, respectively. Additionally, the acid serves to convert the salt back to the organic crystalline compound, while reducing the particle size of the organic crystalline compound to not greater than about 30 microns. Additional oxidizer particles having a mean particle size of not greater than about 30 microns may be added. The additional oxidizer particles comprise a perchlorate salt and/or a nitrate salt. The pyrotechnic composition may then be dried, if necessary or desired.

Other features and advantages of the present invention will become apparent to those of ordinary skill in the art through consideration of the ensuing description, the accompanying drawings and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings.

DETAILED DESCRIPTION OF THE INVENTION

Figure 1:
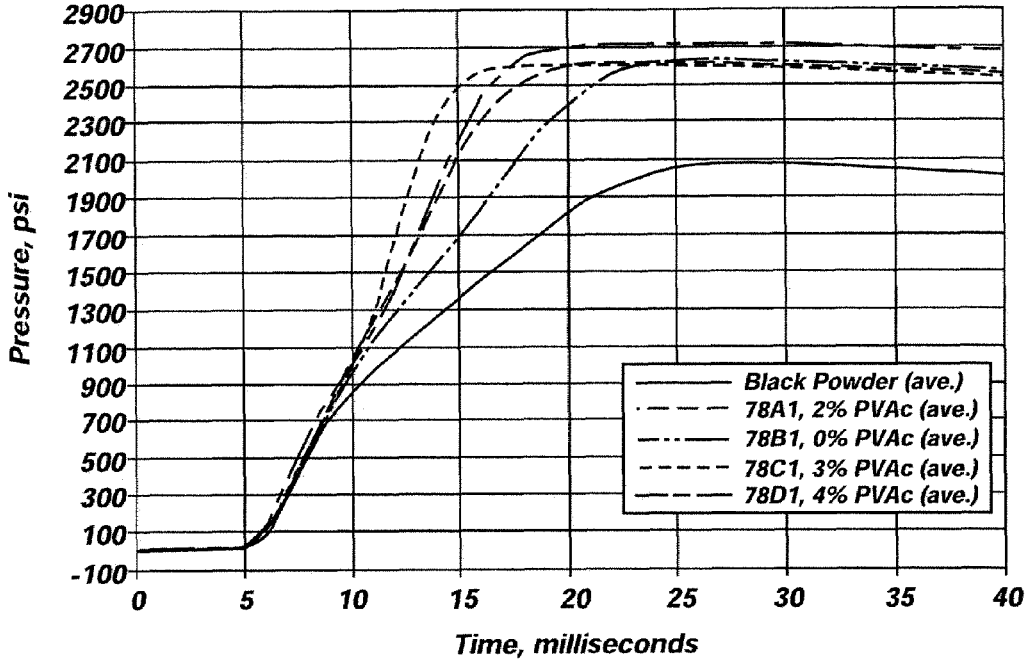
FIG. 1 is a graph comparing the ballistic performance of black powder and moisture-resistant black powder substitute (MRBPS) compositions comprising, on average, 0.0 weight percent (the composition labeled 78B1), 2.0 weight percent (the composition labeled 78A1), 3.0 weight percent (the composition labeled 78C1) and 4.0 weight percent (the composition labeled 78D1) poly(vinyl acetate) (PVAc) binder. Ballistic performance was measured using the Pellet Bundle method in a 90 cc closed bomb, as more fully described below. As is evident, the composition labeled 78C1 and containing 3.0 weight percent binder exhibited the shortest rise time.

The present invention is directed to solid pyrotechnic compositions, including black powder substitute and boron/potassium nitrate ($B/KNO_3$) substitute compositions, and methods for making the same. More particularly, the present invention is directed to solid pyrotechnic compositions, and methods for making the same, having increased moisture resistance (measured in terms of humidity uptake) in comparison to black powder and $B/KNO_3$ compositions. The particular embodiments described herein are intended in all respects to be illustrative rather than restrictive. Other and further embodiments will become apparent to those of ordinary skill in the art to which the present invention pertains without departing from its scope.

Solid pyrotechnic compositions prepared according to the methods of the present invention comprise oxidizer particles and organic crystalline particles. It is currently preferred that oxidizer particles comprise from about 40.0 weight percent to about 90.0 weight percent of the solid pyrotechnic compositions. (All percentages provided herein represent percentage by weight of the total solid pyrotechnic composition unless otherwise noted.) It is currently more preferred that oxidizer particles comprise from about 65.0 weight percent to about 80.0 weight percent of the compositions.

Further, it is currently preferred that the mean particle size of the oxidizer particles is not greater than about 30 microns. It is currently more preferred that the mean particle size of the oxidizer particles is not greater than about 20 microns, and even more preferred that the mean particle size of the oxidizer particles ranges from about 5 microns to about 20 microns.

The oxidizer particles comprise at least one nitrate salt. It is currently preferred that the nitrate salt comprises at least one member selected from the group consisting of alkali metal nitrate and ammonium nitrate. Exemplary alkali metal nitrates include, without limitation, potassium nitrate, cesium nitrate, rubidium nitrate and ammonium nitrate. Potassium nitrate is the currently preferred nitrate salt and is preferably present in a concentration of between 50.0 weight percent and 70.0 weight percent of the total solid pyrotechnic composition.

The oxidizer particles also comprise at least one perchlorate salt. It is currently preferred that the perchlorate salt comprises at least one member selected from the group consisting of potassium perchlorate and ammonium perchlorate. Potassium perchlorate is the currently preferred perchlorate salt.

When used in the currently preferred particle sizes of about 30 microns or less, the perchlorate salt may be instrumental in permitting the omission of sulfur from the pyrotechnic composition without sacrificing ballistic performance. Upon ignition of the solid pyrotechnic composition, the perchlorate salt may decrease ignition delay of the pyrotechnic composition while increasing pressure rise. It is currently preferred that about 0.5 weight percent to about 30.0 weight percent of the total weight of the solid pyrotechnic composition consists of the perchlorate salt. It is currently more preferred that about 5.0 weight percent to about 20.0 weight percent of the solid pyrotechnic composition consists of the perchlorate salt.

It is currently preferred that the organic crystalline particles, as well as optionally present salts of the organic crystalline particles, comprise about 10.0 weight percent to about 60.0 weight percent of the total weight of the solid pyrotechnic composition. It is currently more preferred that solid pyrotechnic compositions prepared according to the methods of the present invention comprise from about 13.0 weight percent to about 22.0 weight percent organic crystalline particles. If a salt of an organic crystalline particle is present in the composition, it is currently preferred that at least about 50.0 weight percent, more preferably at least about 80.0 weight percent, and still more preferably at least about 90.0 weight percent, of the organic crystalline particles be in a salt-free state. It is possible, and currently preferred, to use the organic crystalline particles alone, so that the solid pyrotechnic composition is free of any salts of organic crystalline particles. Although the organic crystalline particles, and their optional salts, may have mean particle sizes as large as about 100 microns, they preferably have mean particle sizes not greater than about 30 microns. More preferably, the organic crystalline particles have mean particle sizes not greater than about 20 microns and, still more preferably, not greater than about 15 microns. It is currently most preferred that the organic crystalline particles have mean particle sizes of not greater than about 10 microns.

It is currently preferred that the organic crystalline particles comprise at least one member selected from the group consisting of phenolphthalein and an organic crystalline compound derived from a reaction between a phenolic compound and phthalic anhydride. By way of example and not limitation, one or more of the 2–6 positions on the phenolic compound and/or one or more of the 2–5 positions on the phthalic anhydride compound may be substituted with functional groups such as —R, —$NH_2$, —$NR^1H$, —$NR^1R^2$, —$NO_2$, —OR and the like, in which R, $R^1$ and $R^2$ are independently selected from, for example, the group consisting of alkyls and aryls.

The solid pyrotechnic compositions of the present invention are not limited to phenolphthalein and its derivatives. Instead, other organic crystalline compounds known to those of ordinary skill in the art may also be used. Representative organic crystalline compounds that may be of use with the present invention are described in United States Patent & Trademark Office Disclosure Document H72 to Wise, et al. and include fluorescein, 1,5-naphthalenediol, anthraflavic acid and terephthalic acid. The disclosure of United States Patent & Trademark Disclosure Document H72 is hereby incorporated by reference herein as if set forth in its entirety.

The solid pyrotechnic compositions of the present invention further comprise one or more nonhygroscopic polymeric binders. Suitable nonhygroscopic polymeric binders include those that uptake (i.e., absorb) less than about 4.0 weight percent moisture at 75.0% relative humidity at a temperature of 21.1° C. (70° F.) over 24 hours. Exemplary nonhygroscopic polymeric binders include, without limitation, alkyl cellulose (e.g., ethyl cellulose), poly(vinyl acetate), poly(vinyl acetate-co-vinyl alcohol), nylon, poly(ethylene-co-vinyl acetate), polyethylene glycol, nitrocellulose, certain chain-extended oxetanes (e.g., polyBAMO), glycidyl azide polymer (GAP) and related polymers.

Suitable solvents may be used in the methods of the present invention for dissolving and/or swelling the nonhygroscopic polymeric binder producing a composition with a thick, putty-like texture promoting shearing action during mixture. This texture allows for efficient extrusion (e.g., ram, single-screw and twin-screw) of MRBPS compositions without phase separation. For example, ethanol is a suitable solvent for ethyl cellulose and ethyl acetate is a suitable solvent for poly(vinyl acetate). It is currently preferred that compositions prepared according to the methods of the present invention comprise ethyl cellulose dissolved in ethanol as the nonhygroscopic polymeric binder/solvent system.

By way of example and not limitation, nonhygroscopic polymeric binders may be present in the pyrotechnic compositions of the present invention in a concentration of not more than about 10.0 weight percent, preferably about 2.0 weight percent to about 6.0 weight percent. It is currently most preferred that nonhygroscopic polymeric binders be present in a concentration of about 3.0 weight percent.

Compared to conventional black powder, the use of a nonhygroscopic binder and the organic crystalline particles lowers the moisture uptake of the solid pyrotechnic compositions prepared according to the methods of the present invention when compared to conventional black powder or $B/KNO_3$ compositions. In currently preferred embodiments, the moisture uptake of the solid pyrotechnic composition is not greater than about 0.3 weight percent, more preferably not greater than about 0.25 weight percent, at 75.0% relative humidity at a temperature of 21.1° C. (70° F.) over a period of 24 hours.

Additionally, by adjusting the proportions of oxidizer salts and organic crystalline compound, it is possible to obtain a formulation having, upon ignition, a theoretical flame temperature not greater than 2300K, preferably in the range of from about 1750K to about 2300K. Generally, increasing the concentration of perchlorate salt will raise the theoretical flame temperature, whereas decreasing the concentration of perchlorate salt will lower the theoretical flame temperature. On the other hand, the theoretical flame temperature has an inverse relationship with the organic crystalline particles. The theoretical flame temperature may be calculated by NASA-Lewis thermochemical calculations, as known to those of ordinary skill in the art. A copy of this program is available through NASA Glenn Research Center, Cleveland, Ohio.

Other ingredients may also be present in compositions prepared according to the methods of the present invention including, without limitation, calcium stearate, graphite, metal or metalloid fuels and fillers. Such ingredients may be present as desired or needed for the intended application of the solid pyrotechnic composition.

In a currently preferred embodiment, the low humidity black powder substitute composition comprises 63.9 weight percent 15 micron potassium nitrate, 15.4 weight percent 20 micron potassium perchlorate, 17.2 weight percent 6 micron phenolphthalein, 3.0 weight percent 100-centipoise grade ethyl cellulose having 49% ethoxy content, and 0.5 weight percent calcium stearate.

In accordance with another embodiment of the invention, a $B/KNO_3$ substitute pyrotechnic composition is provided that comprises perchlorate salt oxidizer particles and organic crystalline particles. Suitable perchlorate salts and organic crystalline particles for this embodiment of the invention may be selected from those described above and listed in connection with the black powder substitute compositions. Generally, $B/KNO_3$ burns at a relatively high theoretical flame temperature, preferably at least about 2300K and, more preferably, in the range of about 2300K to about 3000K. It is possible to obtain such high flame temperature by using a relatively high perchlorate salt loading, such as from about 20.0 weight percent to about 90.0 weight percent. It is currently preferred that a perchlorate salt loading ranging from about 30.0 weight percent to about 90.0 weight percent be used.

It has been found that perchlorate salts have a greater effect on raising theoretical flame temperature than other oxidizers, such as nitrate salts. Generally, in order to regulate theoretical flame temperature,lower loadings of perchlorate salt will be accompanied by higher loadings of other oxidizers (e.g., nitrates) relative to organic crystalline particles and nonhygroscopic polymeric binders. On the other hand, higher loadings of perchlorate salt will be accompanied by low loadings of other oxidizers relative to organic crystalline particles and nonhygroscopic polymeric binders.

According to one exemplary method contemplated for use with the present invention, the binder (e.g., ethyl cellulose) is dry mixed with the organic crystalline particles (e.g., phenolphthalein) and subsequently dissolved in a suitable solvent (e.g., ethanol) in a Hobart mixer (open-bowl bread mixer). The mixture is subsequently mixed for two minutes. Next, the oxidizer particles are added into the Hobart mixer. It is currently preferred that potassium perchlorate particles are added, the mixture is mixed for two minutes and then approximately 60% of the potassium nitrate particles are added. The mixture is then mixed for five minutes, the sides of the container are scraped down and the remaining potassium nitrate particles are added. The mixture is then mixed for five minutes and the sides of the container are scraped down. Subsequent mixing steps promote homogeneity of the composition and evaporation of the ethanol yielding a paste that increases in viscosity with mix time. The mixture is mixed for another fifteen minutes, the sides are again scraped down, and the mixture is mixed for another ten minutes. The sides are then again scraped down and the mixture is mixed until prilled (i.e., until the mix consists of small, solvent-moist spheroidal particles generally 0.25 inch or smaller in diameter). The mix time at which the mix becomes prilled may vary depending on the solvent evaporation rate, which rate depends on, among other factors, the ambient temperature, mix speed and mix bowl size.

The prills are subsequently dried in an oven and then blended with a suitable processing aid (e.g., calcium stearate) for ten minutes in a v-shell blender, granulated (−20 mesh), polished for up to 20 minutes in a v-shell blender and pressed into pellets. It is currently preferred that the calcium stearate coating constitutes about 0.5 weight percent of the particles.

The density of the pellets should be controlled depending on the application for which they are being produced. For example, high-density pellets that are known to combust on the surface of the pellet may be useful as a delay charge. Low-density pellets may pulverize if the shock wave from the ignition train is sufficiently brisant. The resulting high-surface-area granules burn very rapidly. Such a system is useful for ignition trains for ordnance items such as mortars or other applications requiring a rapid ballistic response. Pellets pressed at intermediate densities will combust in an irreproducible manner since pellets may break into a few or several pieces so that the surface area will vary considerably from one firing to the next. For MRBPS and black powder pellets, high-density pellets should have densities of about 90.0% of theoretical density or higher and low-density pellets should have densities of about 84.0% of theoretical maximum density or lower.

Pellets may be used as is, or may be further processed, such as by grinding, to make high density granules having ballistics comparable to granulated black powder. Alternatively, the dried prills (with or without the calcium stearate coating) may then be used as is or with subsequent grinding and/or particle size fractionation directly in various pyrotechnic or ordnance applications.

In a preferred aspect of the method of the present invention, an alkali metal hydroxide, such as potassium hydroxide, is combined with at least one organic crystalline compound, such as phenolphthalein or a phenolphthalein derivative, to produce a solution comprising a salt of the organic crystalline compound. The solution is combined with nitric acid or perchloric acid, or, if desired, a combination of the acids. The alkali metal hydroxide reacts with the nitric acid or perchloric acid to form alkali metal nitrate particles or alkali metal perchlorate particles, respectively. Additionally, the acid serves to convert the salt back to the organic crystalline compound, while preferably reducing the particle size of the organic crystalline compound to not greater than about 30 microns, preferably not greater than about 20 microns. Additional oxidizer particles having a mean particle size of not greater than about 30 microns may be added. This addition or combination step may be performed in situ by reaction of the alkali metal hydroxide with the nitric or perchloric acid to form the oxidizer particles. Thus, the oxidizer particles comprise a nitrate salt and/or a perchlorate salt. The pyrotechnic composition may then be dried, if necessary or desired. By way of example and not limitation, drying may be conducted under vacuum or at atmospheric pressure and may be conducted at room or elevated temperatures. Drying methods are well known in the art.

Determination of mean particle size of various ingredients as a means of quality control after grinding and before addition into the black powder substitute is performed in accordance with standard ISO-13320-1:1999(E) "Particle Size Analysis-Laser Diffraction Methods," the disclosure of which is hereby incorporated herein by reference as if set forth in its entirety. Generally, this standard describes deriving the mean particle size from a matrix conversion of angular light scattering intensity measurements as a function of scattering angle and wavelength of light. Suitable algorithms are based on the Fraunhauffer forward light scattering theory, which incorporates the refractive indices of both the same and the carrier medium.

With a MICROTRAC® particle analyzer system, available from Microtrac, Inc. of North Largo, Fla., a recirculating bath is used to present a suspended stream of particles to the instrument's optical cell. Inside the cell, the suspended stream of particles is impinged by a small laser beam, creating a diffraction pattern of light. This diffraction pattern of light is converted into an energy distribution matrix which yields the various particle size properties such as intensity, distribution, mean diameter, cumulative volume and so forth for the given sample.

The solid pyrotechnic compositions of the present invention are useful for various applications, including, by way of example and not limitation, as delay charges, propulsion charges, expulsion charges and initiators or first fire compositions used with gas generants, propellants and the like. The solid pyrotechnic compositions of the present invention may be used, for example, in flares, rocket motors, a host of ordnance devices and secondary restraint systems (e.g., air bag devices) in vehicles.

The following examples serve to explain embodiments of the present invention in more detail. These examples are not to be construed as being exhaustive or limiting as to the scope of the present invention.

EXAMPLES

Example I

Evaluation of the Effect of the Relative Amount of Nonhygroscopic Polymeric Binder In order to evaluate the effect of the relative amount of nonhygroscopic polymeric binder on moisture-resistant black powder substitute (MRBPS) compositions prepared according to the methods of the present invention, a series of compositions was prepared which comprised varying amounts of poly(vinyl acetate) (PVAc) nonhygroscopic polymeric binder and 20.0 weight percent potassium perchlorate (KP) oxidizer. "Moisture-resistant black powder substitute (MRBPS) compositions," as that term is used herein, refers to compositions prepared according to the methods of the present invention, which compositions exhibit low humidity uptake in comparison to conventional black powder and/or $B/KNO_3$ compositions.

A first composition comprising 0.0 weight percent PVAc was prepared and labeled 78B1. Three additional compositions comprising 2.0, 3.0 and 4.0 weight percent PVAc were also prepared and labeled 78A1, 78C1 and 78D1, respectively. The ballistic performance of these MRBPS compositions was then evaluated using the Pellet Bundle method in a 90 cc closed bomb. In the Pellet Bundle method, mortar ignition cartridge pellets (0.20" OD, 0.05" ID and typically 160–200 mg) were characterized by igniting three grams of pellets in a 90 cc closed bomb. The ignition train consisted of an electric match and 111 mg of −24/+60 mesh $B/KNO_3$ granules tied in a tissue bag. This bag and the pellets are tied in an overall tissue bag. The energy produced by the electric match/igniter granule combination was designed to produce the same energy per pellet as the Federal 150 primer produces in single-pellet mortar ignition cartridges. The results of this ballistic evaluation are shown in the graph of FIG. 1.

The composition labeled 78B1, which contained 0.0 weight percent PVAc, exhibited a long rise time relative to the MRBPS compositions comprising 2.0 (the composition labeled 78A1), 3.0 (the composition labeled 78C1) and 4.0 (the composition labeled 78D1) weight percent PVAc, respectively. The composition labeled 78C1 comprising 3.0 weight percent PVAc exhibited the shortest rise time.

Notably, the composition labeled 78C1 comprising 3.0 weight percent PVAc had a shorter rise time than the composition labeled 78A1 comprising 2.0 weight percent PVAc, and also had a shorter rise time than the composition labeled 78D1 comprising 4.0 weight percent PVAc. While not held to any one theory, the inventors hereof believe that one possible explanation for the ballistic performance of pellets prepared from MRBPS compositions as a function of increasing binder is that the binder adds viscosity to the MRBPS composition slurry in ethyl acetate (solvent) during mixing. This, in turn, produces higher shear and, thus, more efficiently mixed MRBPS compositions. Thus, compositions comprising 2.0 weight percent (the composition labeled 78A1) and 3.0 weight percent (the composition labeled 78C1) PVAc have improved ballistic performance relative to the composition without binder (the composition labeled 78B1). However, once 4.0 weight percent binder has been added (the composition labeled 78D1), the increased PVAc begins to adversely affect rise time.

Pellet crush strength of the compositions, as well as a composition prepared which comprised 3.0 weight percent ethyl cellulose (EtCel) binder (the composition labeled 78E1 in FIG. 2), was also evaluated. (The ethyl cellulose utilized in this composition was 100-centipoise grade ethyl cellulose having 49% ethoxy content, purchased from Sigma-Aldrich, Inc. However, similar results have been obtained in subsequent experiments using Ethocel 100 centipoise, standard grade (49% ethoxy content) fine powder purchased from The Dow Chemical Company.) The results of this evaluation are shown in Table I.

TABLE I

Average Crush Strength and Density Data for MRBPS Samples Containing 20.0 Weight Percent Potassium Perchlorate Oxidizer, Having a 1.4 Fuel-to-Oxidizer Ratio and Containing Differing Amounts of Binder as Indicated.

| Formulation | % Binder | Radial Crush Strength (kg) | Actual Density (AD) (g/cc) | Theoretical Maximum Density (TMD) (g/cc) | Fraction of Theoretical Density (AD/TMD) |
|---|---|---|---|---|---|
| Black Powder | None | 4.3 | 1.733 | 1.980 | 0.875 |
| 78B1 | None | 1.5 | 1.568 | 1.892 | 0.829 |
| 78A1 | 2.0% PVAc | 3.1 | 1.524 | 1.879 | 0.811 |
| 78C1 | 3.0% PVAc | 3.6 | 1.540 | 1.872 | 0.823 |
| 78D1 | 4.0% PVAc | 4.6 | 1.552 | 1.866 | 0.832 |
| 78E1 | 3.0% EtCel | 3.5 | 1.554 | 1.878 | 0.828 |

It can be seen from Table I, that crush strength is improved as binder level increases. Changing the binder from PVAc to ethyl cellulose (EtCel) does not appear to have a significant effect on pellet crush strength.

In addition to optimal ballistic performance, adding 3.0 weight percent nonhygroscopic polymeric binder to compositions prepared according to the methods of the present invention produces a composition with a thick, putty-like texture when the appropriate amount of solvent (e.g., ethyl acetate if PVAc binder is being used) has been added. If used for production scale-up, this texture allows for efficient extrusion of MRBPS compositions without phase separation. Furthermore, compositions having 3.0 weight percent binder produce tough granules that do not undergo significant attrition with handling, which makes them an excellent candidate for a pellet feedstock or directly as granules in pyrotechnic and ordnance applications. Once pressed, pellets with 3.0 weight percent binder also have good crush strength and significant resistance to attrition.

Example II

Selection of a Nonhygroscopic Polymeric Binder/Solvent System

In order to determine the optimal nonhygroscopic polymeric binder/solvent system for compositions prepared according to the methods of the present invention, a number of compositions were evaluated. The compositions comprised, respectively, 3.0 weight percent PVAc binder and 10.0 weight percent KP oxidizer (the composition labeled 84B1), 3.0 weight percent EtCel binder and 10.0 weight percent KP oxidizer (the composition labeled 84E1), 3.0 weight percent PVAc binder and 20.0 weight percent KP oxidizer (the composition labeled 78C1) and 3.0 weight percent EtCel binder and 20.0 weight percent KP oxidizer (the composition labeled 78E1). (Note that the compositions labeled 78C1 and 78E1 were also evaluated in Example I, above.) The compositions comprising PVAc binder (those compositions labeled 84B1 and 78C1) were processed in ethyl acetate solvent and the compositions comprising EtCel binder (those compositions labeled 84E1 and 78E1) were processed in ethanol solvent.

Figure 14:
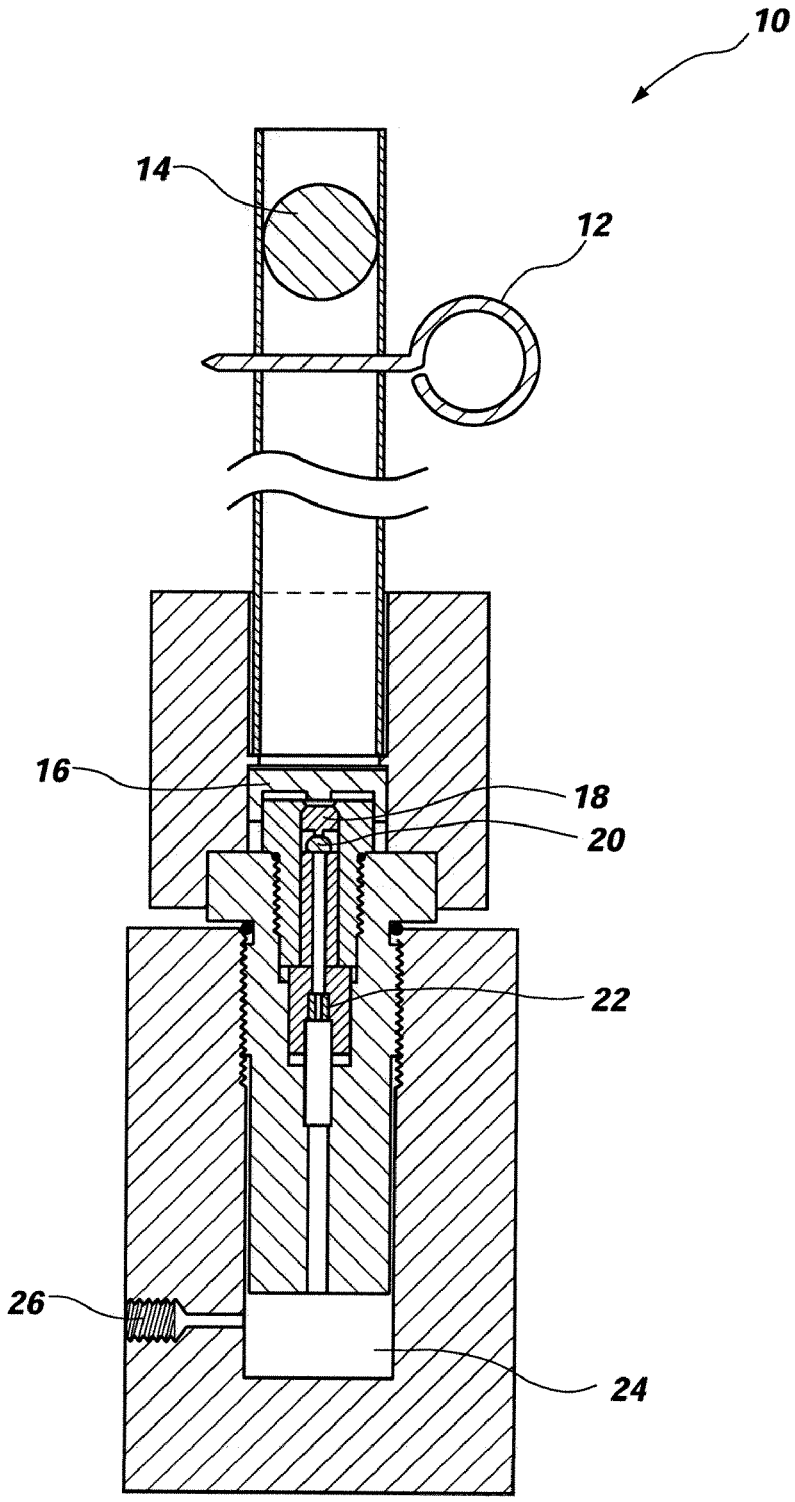
FIG. 14 is a schematic illustration of a primer bomb designed to attach an M299 Ignition Cartridge to an instrumented 22 cc closed bomb, which primer bomb may be utilized for measuring ballistic performance.

The ballistic performance of these MRBPS compositions was then evaluated using the Primer Bomb method and compared to conventional black powder. An exemplary primer bomb for use in the Primer Bomb method is schematically illustrated in FIG. 14 and designated generally as reference numeral 10. The primer bomb 10 was fabricated as a means of evaluating ballistic performance of pellets in an actual mortar ignition cartridge, a much more realistic environment for the pellets. As is evident, the ignition cartridge (e.g., an M299 Ignition Cartridge assembled by Pocal Industries of Scranton, Pa.) is attached to a 22 cc closed bomb instrumented with a pressure transducer. It allows acquisition of pressure (P) vs. time (t) data when igniting a black powder or MRBPS pellet in actual ignition cartridge (e.g., M299 Ignition Cartridge) hardware by a primer (e.g., a Federal 150 primer manufactured by Federal Cartridge Company of Anoka, Minn.).

More particularly, the test setup works as follows: First, the pull pin 12 is removed and the steel ball 14 drops about 24 inches onto the striker 16. The striker 16 hits the primer pin 18, which initiates the primer 20. The primer 20, in turn, initiates the pellet 22. The pellet 22 reacts, rapidly, creating high-pressure gas which expands into the 22 cc bomb 24. The pressure transducer 26 detects the pressure increase in the bomb 24, which increase is recorded electronically as a function of time.

Figure 2:
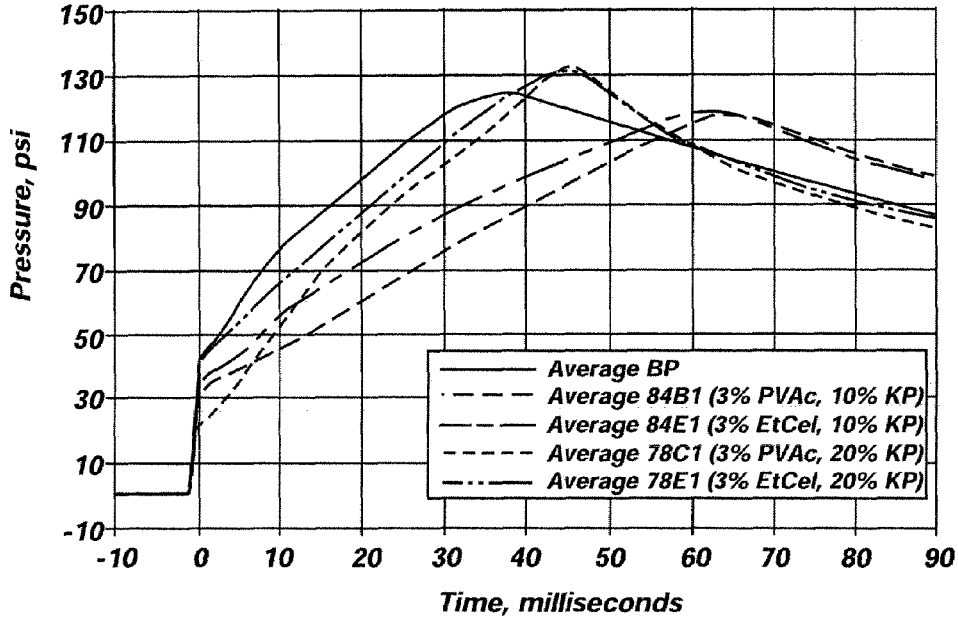
FIG. 2 is a graph comparing the ballistic performance of black powder and MRBPS compositions comprising 3.0 weight percent PVAc binder and 10.0 weight percent potassium perchlorate (KP) oxidizer (the composition labeled 84B 1), 3.0 weight percent ethyl cellulose (EtCel) binder and 10.0 weight percent KP oxidizer (the composition labeled 84E1), 3.0 weight percent PVAc binder and 20.0 weight percent KP oxidizer (the composition labeled 78C1) and 3.0 weight percent EtCel binder and 20.0 weight percent KP oxidizer (the composition labeled 78E1). Ballistic performance was measured using the Primer Bomb method, as more fully described below. As is evident, the choice of PVAc or EtCel binder did not significantly affect the rise time of the pellets.

The results of the ballistic evaluation are shown in the graph of FIG. 2. As is evident, the rise time of the composition labeled 84E1 (comprising 3.0 weight percent EtCel) is comparable to that of the composition labeled 84B1 (comprising 3.0 weight percent PVAc), both compositions comprising 10.0 weight percent potassium perchlorate (KP). Also having comparable rise times are the composition labeled 78E1 (comprising 3.0 weight percent EtCel) and the composition labeled 78C1 (comprising 3.0 weight percent PVAc), both compositions comprising 20.0 weight percent KP. Thus, the choice of nonhygroscopic polymeric binder/solvent system, as between PVAc/ethyl acetate and EtCel/ethanol, does not appear to have a significant effect on ballistic performance.

As previously discussed, pellet crush strength was also evaluated with regard to the composition labeled 78C1 (comprising 3.0 weight percent PVAc binder) and the composition labeled 78E1 (comprising 3.0 weight percent EtCel binder). The difference in pellet crush strength between these compositions, and thus between compositions having PVAc vs. EtCel nonhygroscopic polymeric binder, does not appear to be significant (see, Table I).

Figure 3:
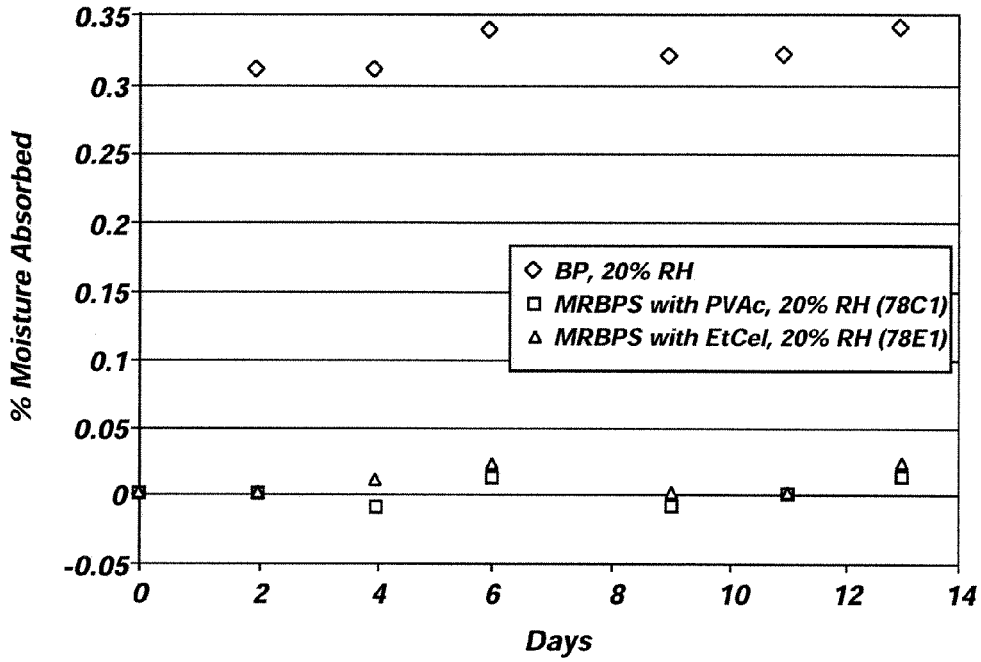
FIG. 3 is a graph comparing, at 20.0% relative humidity (RH), the moisture absorption of black powder and MRBPS compositions comprising 3.0 weight percent PVAc binder and 20.0 weight percent KP oxidizer (the composition labeled 78C1) and 3.0 weight percent EtCel binder and 20.0 weight percent KP oxidizer (the composition labeled 78E1).
Figure 4:
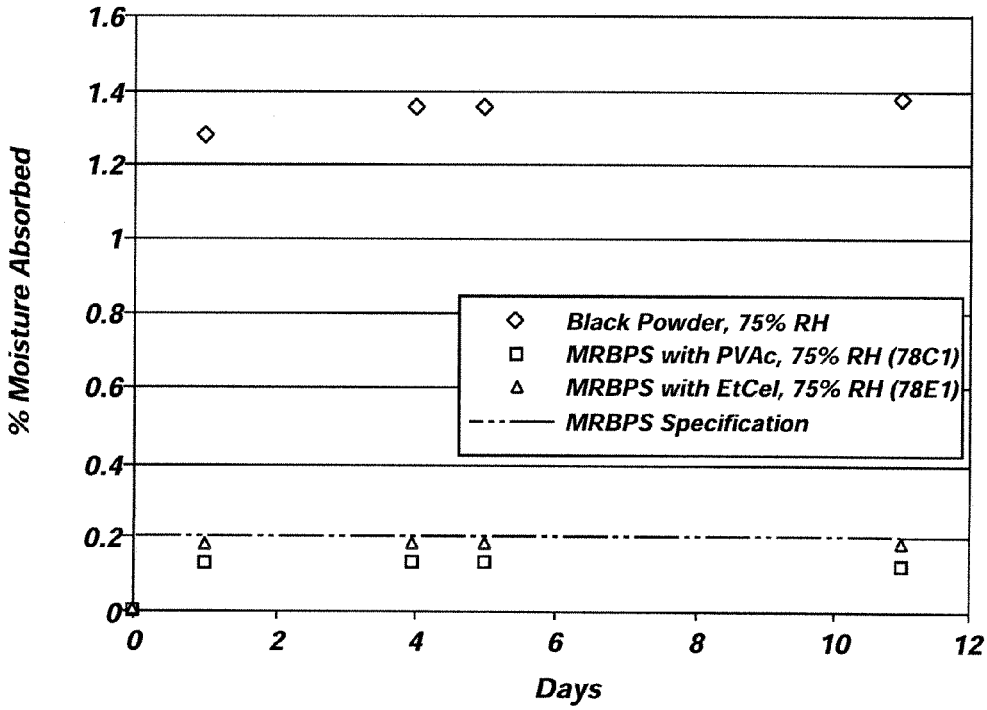
FIG. 4 is a graph comparing, at 75.0% RH, the moisture absorption of black powder and MRBPS compositions comprising 3.0 weight percent PVAc binder and 20.0 weight percent KP oxidizer (the composition labeled 78C1) and 3.0 weight percent EtCel binder and 20.0 weight percent KP oxidizer (the composition labeled 78E1).
Figure 5:
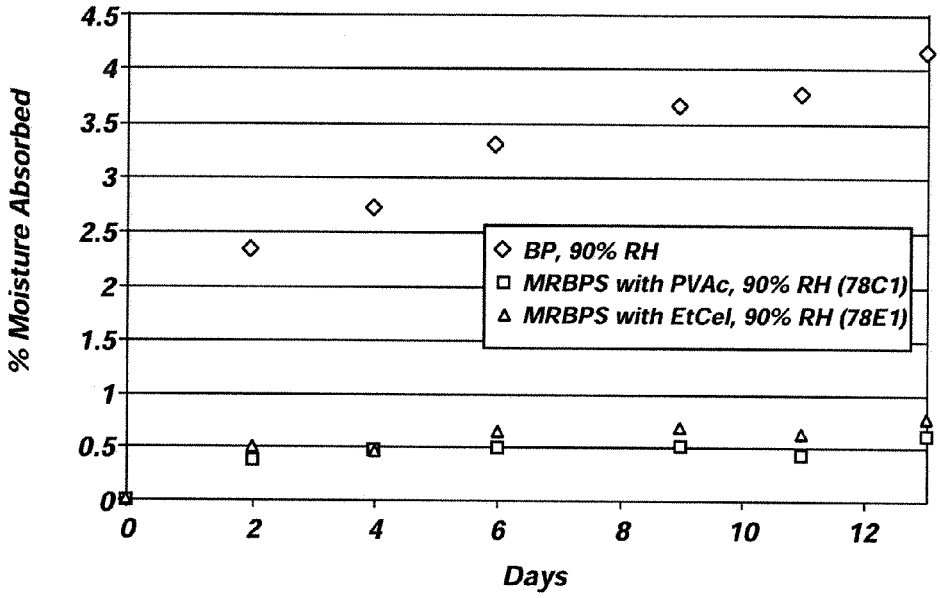
FIG. 5 is a graph comparing, at 90.0% RH, the moisture absorption of black powder and MRBPS compositions comprising 3.0 weight percent PVAc binder and 20.0 weight percent KP oxidizer (the composition labeled 78C1) and 3.0 weight percent EtCel binder and 20.0 weight percent KP oxidizer (the composition labeled 78E1).

Moisture absorption at 20.0% relative humidity (RH), 75.0% RH and 90.0% RH was also evaluated with regard to the composition labeled 78C1 (comprising 3.0 weight percent PVAc binder), the composition labeled 78E1 (comprising 3.0 weight percent EtCel binder) and conventional black powder. The results of these evaluations are shown in the graphs of FIGS. 3, 4 and 5, respectively. As is evident from these figures, compositions comprising EtCel binder absorb slightly more moisture than compositions comprising PVAc binder over the range of relative humidities. Thus, from a binder standpoint, compositions comprising EtCel binder are slightly less favored than compositions comprising PVAc binder.

However, ethanol, the solvent used to dissolve EtCel, is less volatile than ethyl acetate, the solvent used to dissolve PVAc. Thus, processing hazards for compositions comprising PVAc are higher than those for compositions comprising EtCel since the flash point of ethanol (62° F.) is higher than that of ethyl acetate (26° F.). For a given solvent level, mix times required to produce prilled MRBPS are longer for ethanol, but mix times can be adjusted to a reasonable length by decreasing the solvent level. Accordingly, the nonhygroscopic polymeric binder/solvent system comprising ethyl cellulose and ethanol appears to be optimal from a processing standpoint.

Example III

Effect of the Order of Addition of Constituents

MRBPS compositions were prepared using two different processes in which the primary difference was the order of addition of the constituents. In the first process, a solution of PVAc in ethyl acetate was added to potassium nitrate (KN) and potassium perchlorate (KP) oxidizers and mixed for three minutes. Subsequently, the constituents were scraped down and phenolphthalein was added to form a mixture. The mixture was then scraped down and mixed for five minutes. This was followed by another scrape down and the resultant mixture was mixed until prilled.

In the second process, a solution of PVAc in ethyl acetate was added to phenolphthalein and mixed for two minutes. Subsequently, the constituents were scraped down and KP was added to form a mixture. The mixture was mixed for two minutes and scraped down. Potassium nitrate was subsequently added to the mixture. The mixture was then mixed for five minutes, scraped down and mixed for an additional five minutes. This was followed by an additional scrape down and the resultant mixture was mixed until prilled.

Figure 6:
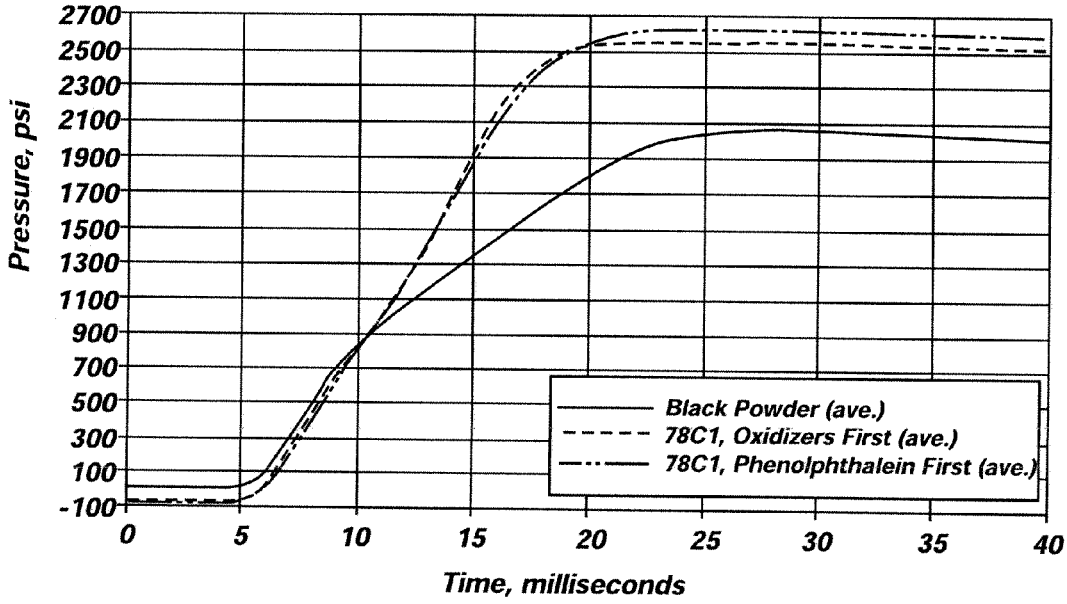
FIG. 6 is a graph comparing the ballistic performance of black powder and MRBPS compositions prepared by premixing PVAc in ethyl acetate solvent (the "solvent premix" method) and prepared by dry blending PVAc with phenolphthalein (the "dry blend" method). Ballistic performance was measured using the Pellet Bundle method.

The ballistic performance of compositions prepared according to the two processes was subsequently evaluated using the Pellet Bundle method in a 90 cc closed bomb (as described in Example I, above). The results of this evaluation are shown in FIG. 6. As is evident, the difference in processing had little observable difference on ballistic performance. However, the second method permits more efficient dispersal of the fuels with the most potent oxidizer, KP, before the addition of KN.

Example IV

"Solvent Premix" vs. "Dry Blend" Methods

In conventional processes for producing black powder and B/$KNO_3$, and in the process sequences described above in Example III, the binder is predissolved in its respective solvent prior to addition to the mixture. This process sequence is referred to herein as the "solvent premix" method. It takes extra time to create the predissolved solution and requires additional capital equipment and facility space. Further, when the solution is subsequently added to the mixture, the amount of binder actually added is questionable. The solution is rather viscous and some nonhygroscopic polymeric binder/solvent syrup remains, coating the side of the solution container. If more solvent is used to rinse the bottle, then either less solvent can be used to dissolve the binder or the mix cycle will take longer in order to evaporate the extra solvent.

The inventors hereof have determined that preparation of a premix may be eliminated by dispersing a finely powdered binder, such as EtCel, or a finely prilled binder, such as PVAc, in the organic crystalline particles (e.g., phenolphthalein) prior to adding the solvent. This process sequence is referred to herein as the "dry blend" method. The dry blend method does not allow the binder particles a chance to aggregate into a sticky mass before they dissolve. This minor process change saves all the prep work involved with predissolving the binder and it eliminates the question of just how much of the binder makes it into the mixture.

Figure 7:
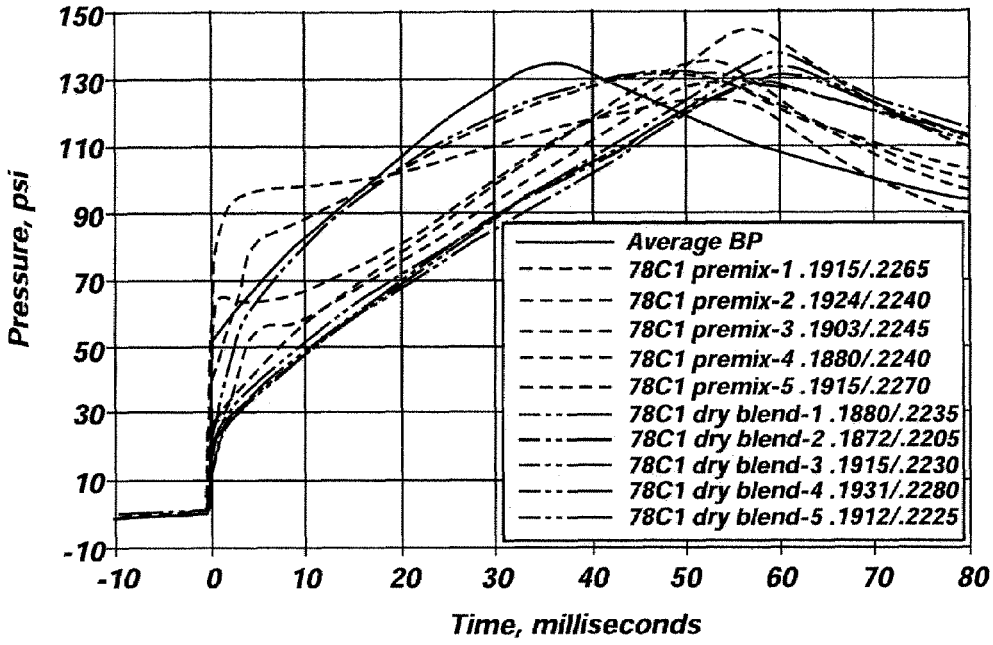
FIG. 7 is a graph comparing the ballistic performance of black powder and MRBPS compositions comprising PVAc binder prepared using the solvent premix and dry blend methods. Ballistic performance was measured using the Primer Bomb method.

Two lots of MRBPS compositions having the formulation of the composition labeled 78C1 (see, Example I) were prepared, one according to the solvent premix method and one according to the dry blend method. The ballistic performance of the compositions was subsequently evaluated using the Primer Bomb method (as described in Example II, above) and compared to the ballistic performance of conventional black powder. The results of this evaluation are shown in the graph of FIG. 7. As is evident, the rise time is slightly shorter for compositions prepared using the dry blend method. However, compositions prepared using the dry blend method appear to exhibit better reproducibility. Further, the dry blend method provides relatively greater ease of processing.

Dispersal of the nonhygroscopic polymeric binder EtCel has been found to be more efficient than dispersal of PVAc when using the dry blend method since the particle size of the former is considerably smaller, about 50 microns vs. about 500 microns, respectively.

Example V

Solvent Level/Mixing Time

Figure 8:
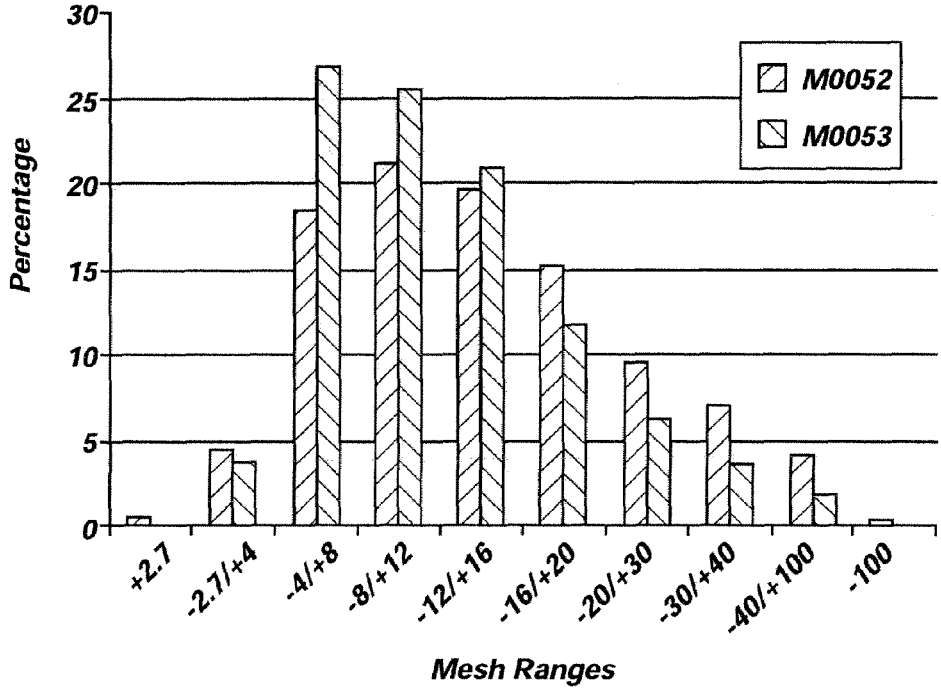
FIG. 8 illustrates the effect of MRBPS processing by the solvent premix and dry blend methods. The bulk of each composition has a prill diameter of less than 0.25 inch (−4 mesh). The compositions of the lot labeled M0052 had a slightly smaller prill size than the compositions of the lot labeled M0053.

The "end of mix" for producing MRBPS compositions is governed by the consistency of the mixture. Generally speaking, once all of the ingredients have been added to the mixture, the consistency is that of a thick paste. As the mix cycle proceeds in a suitable mixing device (e.g., an open-bowl Hobart mixer or an enclosed mixer where evaporation can be controlled through the application of heat, vacuum, or a flow of gases over the mix or a combination of these techniques) and the solvent evaporates, this paste becomes thicker and thicker. Eventually, the paste breaks up from a continuous mass into prills, i.e., small spheriodal particles. As the mix progresses further, these prills become smaller and harder. The "end of mix" is defined as the point when most of the prills are 0.25 inch in diameter or smaller. The graph of FIG. 8 illustrates prill size distribution of an MRBPS composition at the end of mix. As is evident, the bulk of each composition has a prill diameter less than 0.25 inch (−4 mesh). Compositions of lot M0052 have a slightly smaller prill size than compositions of lot M0053. Alternatively, if a mixing device provides sufficient shear to congeal ingredient particles with the slurrying solvent into a thick paste (e.g., a single or twin-screw extruder) at low solvent levels (e.g., below about 15 weight percent), evaporation of the solvent during mixing may not be necessary to produce a material that, when dried and subsequently granulated, will produce a material with acceptably high bulk density.

The main driver for determining the length of the mix cycle using evaporative mixing is the amount of solvent added at the beginning of the mix. It is currently preferred that the concentration of solvent present in the MRBPS compositions of the present invention at the end of mix be between about 8.0 weight percent and 15.0 weight percent of the total weight of the mix. It is currently more preferred that the concentration of solvent at the end of mix be between about 10.0 weight percent and 13.0 weight percent.

Mixes in ethyl acetate solvent (i.e., those comprising PVAc binder) were generally mixed at levels of 25.0 weight percent and 30.0 weight percent of the total weight of the mix. Total mix times were 23±3 minutes and 50±3 minutes, respectively. The ethyl acetate level at the end of mix was determined to be 12±1 weight percent.

Figure 9:
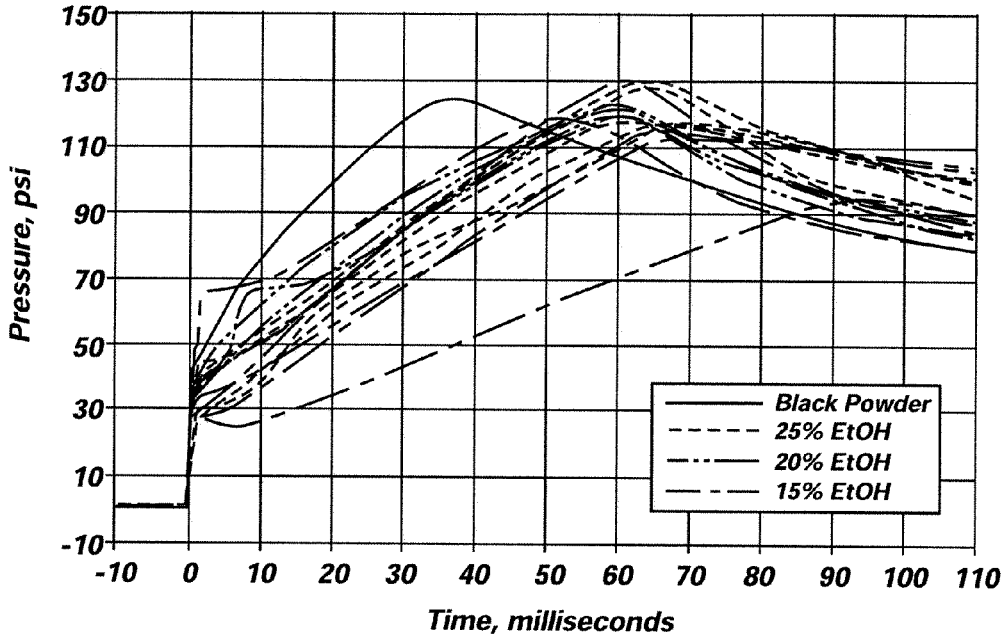
FIG. 9 is a graph comparing the ballistic performance of black powder and MRBPS compositions comprising 10.0 weight percent KP oxidizer and 3 0 weight percent EtCel binder, and having a 1.4 fuel-to-oxidizer ratio. The MRBPS compositions comprised varying amounts of ethanol solvent, with compositions comprising 15.0, 20.0 and 25.0 weight percent ethanol being evaluated. Ballistic performance was measured using the Primer Bomb method. As is evident, rise times did not vary significantly between the compositions. However, significant variability existed for pellets derived from MRPBS compositions mixed with 15.0 weight percent ethanol solvent.

MRBPS compositions having the formulation of the composition labeled 84E1 (see, Example II), were mixed with 15.0, 20.0 and 25.0 weight percent ethanol, respectively. The time required for these mixes was 25, 50 and 62 minutes, respectively. Ballistic performance of these compositions was subsequently evaluated using the Primer Bomb method (as described in Example II, above). The results of this evaluation are illustrated in the graph of FIG. 9.

As is evident, the average rise time for each composition (five pellet average) was 70±17 msec, 61.9±3.1 msec and 65.7±1.5 msec, respectively. The variability in rise time increased very significantly between pellets derived from the composition prepared using 15.0 weight percent ethanol and pellets derived from the composition prepared using 20.0 weight percent ethanol. While not being held to any one theory, the inventors hereof believe that this may be due to the fact that the mix time increased from 25 to 50 minutes as the level of solvent increased from 15.0 to 20.0 weight percent. The former composition may not be sufficiently homogenous due to the lack of sufficient mix time. Ballistic variability decreased further in the composition processed with 25.0 weight percent ethanol, although the average rise time was slightly longer.

An optimal ethanol baseline level for MRBPS compositions having the formulation of the composition labeled 84E1 (see, Example II) appears to be 21.75 weight percent. Mix times at this solvent level were 48.2±2.5 minutes. Ethanol levels at the end of mix for MRBPS compositions having the formulation of the composition labeled 84E1, the binder being dissolved in 21.75 weight percent ethanol, were 11.8±0.5%.

Example VI

Transition from the 1-Gallon to the 3-Gallon Mixer

When produced on a large scale, the MRBPS compositions of the present invention will likely be prepared using a larger mixer bowl than that used to conduct the experiments of the examples described herein. Accordingly, to determine whether this change would have any effect on the MRBPS compositions produced, compositions having the formulation of the composition labeled 78E1 (see, Example II) were prepared both in a 1-gallon (900 g) mixer bowl and a 3-gallon (2,500 g) mixer bowl using a Hobart mixer. The only difference in how the mixes proceeded was that the mix time required for the MRBPS compositions to reach the prilled state was slightly shorter for those compositions prepared using the 3-gallon mixer bowl, even though the same mixer was used at the same mix speed. However, with the 3-gallon mixer bowl, a larger diameter blade was required. As a larger diameter blade increases the amount of torsional force exerted on the mix, it follows that the heat introduced by the additional mechanical energy would promote more rapid evaporation of the ethanol and would decrease the time required for the MRBPS compositions to reach the prilled state. The optimal ethanol level while mixing the currently preferred embodiment of the MRBPS compositions of the present invention in a 3-gallon Hobart mixer is 26.25 weight percent.

Example VII

Pellet Feedstock Development

Initially, pellet feedstock was produced by granulating moist prills on the Stokes granulator using a 20-mesh screen, drying the prills and regranulating the prills to make a more spherical granule. These granules were then placed into the feed funnel of the rotary press in preparation for pressing into pellets. Several challenges related to pellet pressing became evident over the course of the process development. Most of these challenges had their origins in the nature of the pellet feedstock. For an in-depth discussion of these challenges and how it was sought to address them, see Examples VIII through XI.

Examples VIII

Addition of Dry Lubricant

Using the solvent premix method, ignition cartridge pellets were firmly lodged into the die after being pressed. It was found that this even caused the pressing table of the rotary press to vibrate because, as the lower punch attempted to push the pellet out of the die, it would not release readily. In fact, the lower punch exerted sufficient force so that the die and the die table to which the die was attached moved upward until the pellet finally released from the die. Then the die table sprung back into place, finishing the vibratory motion and producing some very disconcerting clatter. This problem was addressed by blending the granules with the dry lubricant calcium stearate prior to pressing. After this process change was effected, ignition cartridge pellets released readily from the pellet dies. In earlier work, pellets were pressed without the use of a dry lubricant. However, these pellets were pressed to one-half the current height, promoting thier release from the die.

Figure 10:
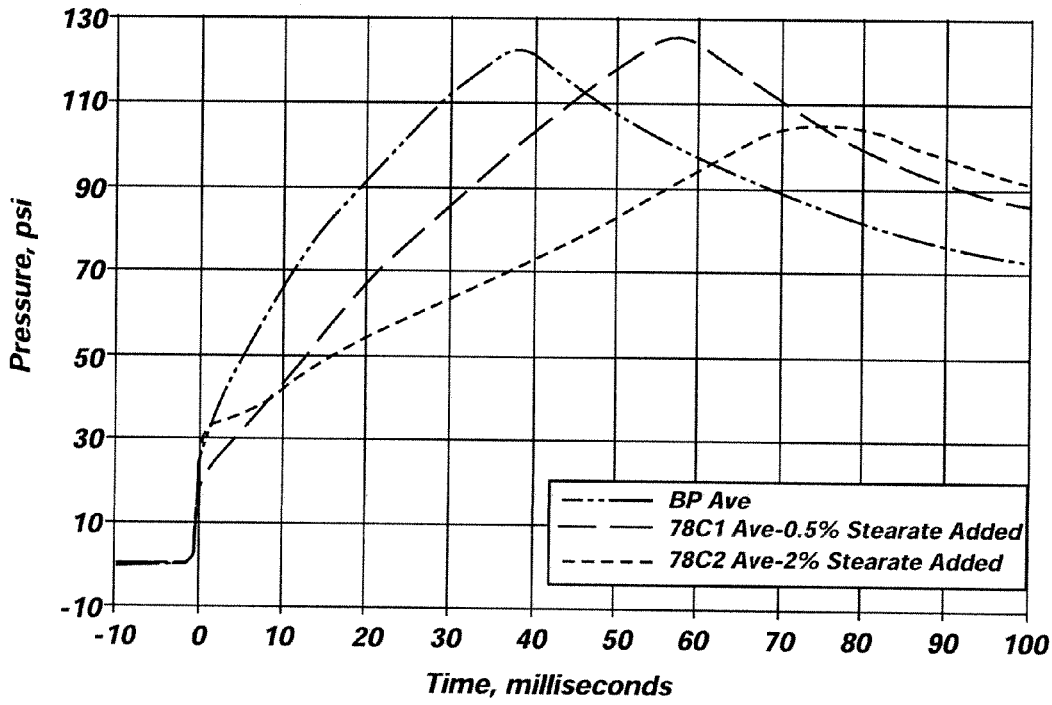
FIG. 10 is a graph comparing the ballistic performance, using the Primer Bomb method, of black powder containing no dry lubricant and MRBPS compositions comprising 20.0 weight percent KP oxidizer and 3.0 weight percent PVAc binder, and having a 1.4 fuel-to-oxidizer ratio, pressed with 0.5 weight percent (the composition labeled 78C1) and 2.0 weight percent (the composition labeled 78C2) calcium stearate dry lubricant. As is evident, the composition labeled 78C2 had a significantly higher rise time than either the black powder or MRBPS composition labeled 78C1.

Typically, 0.5 weight percent calcium stearate was blended into the MRBPS compositions prepared according to the methods of the present invention, although levels as high as 2.0 weight percent were investigated, as described below. MRBPS compositions were prepared comprising 20.0 weight percent potassium perchlorate and 3.0 weight percent PVAc, and having a 1.4 fuel-to-oxidizer ratio. Subsequently, these compositions were pressed with 0.5 weight percent (the composition labeled 78C1) and 2.0 weight percent (the composition labeled 78C2) calcium stearate (dry lubricant). The ballistic performance of these compositions was evaluated using the Primer Bomb method (as described in Example II, above) and compared to that of conventional black powder containing no dry lubricant. The results of this evaluation are illustrated in the graph of FIG. 10. As is evident, higher levels of calcium stearate caused a significant increase in rise time.

Figure 11:
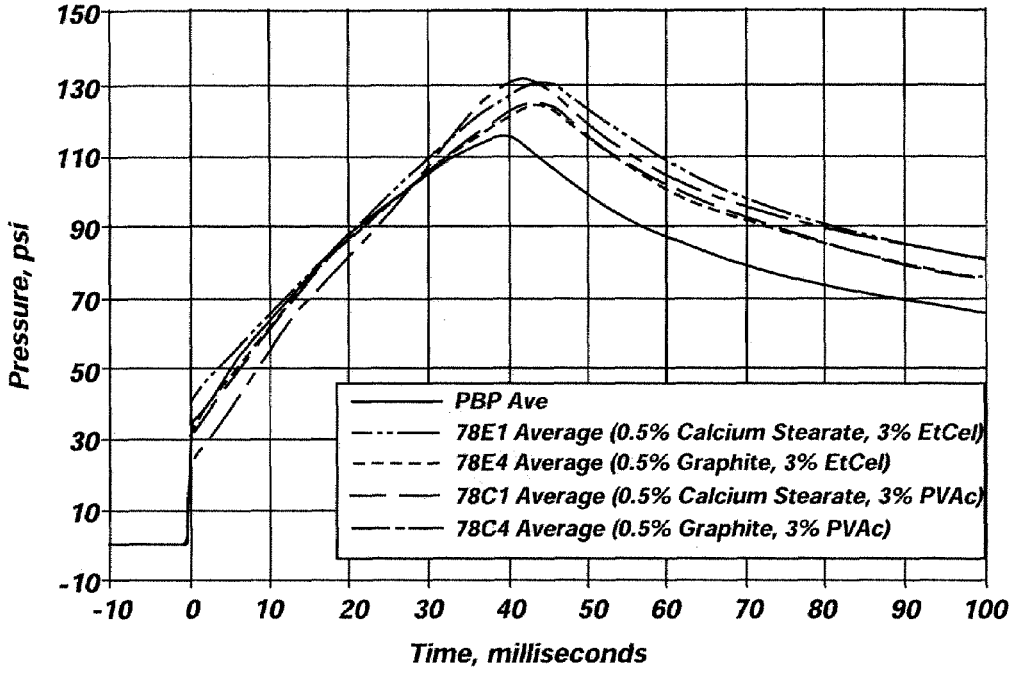
FIG. 11 is a graph comparing the ballistic performance, using the Primer Bomb method, of black powder and MRBPS compositions comprising 20.0 weight percent KP oxidizer and having a 1.4 fuel-to-oxidizer ratio, pressed with 0.5 weight percent press release agent and 3.0 weight percent binder. As is evident, press release agent and binder identity had no significant effect on ballistic performance.

The use of graphite as a die release agent was investigated briefly. Its addition had little or no effect on ballistic performance, measured using the Primer Bomb method (as described in Example II, above), of the MRBPS compositions evaluated (see, FIG. 11). However, it was not nearly as effective as calcium stearate in promoting the release of pellets from the die.

Example IX

Enhancement of Pour Density

Two further challenges became evident while pressing the compositions into pellets. First, in order to produce pellets with a more reproducible ballistic response, pellets were pressed at higher densities. This alleviated pellet breakage by the shock wave produced as a result of primer initiation but created another challenge: sufficient granules to produce the higher-density pellets could not feed into the reservoir created by the inner radial surfaces of the die and the top of the lower punch, even when the punch depth in the die was adjusted to be as low as possible. This suggested the need to produce pellet feedstock with a higher bulk density so that a larger mass of granules could fit into the limited volume of the die reservoir.

The second challenge which became evident was that pellet density decreased significantly over the course of a run, even before the feed funnel holding the pellet feedstock was empty. Near the end of a run, a greater population of coarser granules was observed on the die table than at the beginning. This suggested that the finer granules were feeding more efficiently than those that were coarse.

It became evident from these observations that granule density and morphology may be improved. Two methods were identified as potential means to monitor progress in producing a pellet feedstock more amenable to pressing dense pellets consistently throughout a pressing run. In the first method, the "pellet weight" method, the rotary press was adjusted to produce pellets with nominal heights and densities for a given lot of pellet feedstock. The settings on the press were not adjusted as various lots of pellet feedstock to be analyzed were pressed for a prescribed period of time. Dimensions and weights of randomly selected pellets were measured and the resulting values were averaged. The averaged values were then compared. Lots that produced pellets with higher densities and lower standard deviations contained higher-quality feedstock.

In the second method, the "granule fill density" method, pellet feedstock was poured into a container with a level top surface until the container overflowed. Care was taken in order to not disturb or vibrate the container in any way. The excess granules were then removed from the top of the container with a straight edge. The mass of granules in the beaker was then measured and the density of the granules in the container (volume predetermined) was calculated.

Example X

Methods to Improve Feeding of Pellet Feedstock Granules

Three methods were investigated to improve feeding of pellet feedstock granules with varying results. In the first method, additional dry lubricant was blended into the feedstock. In the second method, granulation of moist MRBPS prills was followed by drying, granulation and further grinding. In the third method, prilled MRBPS was dried prior to grinding. The results of these methods are discussed in subsections X(a) through X(c) hereinbelow.

Example X(a)

Blending Additional Dry Lubricant into the Feedstock

When calcium stearate was originally blended into the MRBPS compositions, it was noted that pellet density increased significantly, even though the settings on the Manesty press had not been changed. This suggested that calcium stearate reduces either the friction of MRBPS granules as they fill the die reservoirs on the press or granule-granule electrostatic repulsion. Both theories would explain enhanced fill into the die reservoirs on the press allowing formation of a denser pellet.

The amount of calcium stearate blended with the MRBPS was increased from 0.5 weight percent to 2.0 weight percent. The effect of this change was monitored using the pellet weight method described hereinabove in Example IX. The results in Table II show a slight improvement in granule feeding. The added calcium stearate helped slightly in increasing granule fill into the reservoirs. Also, changing from shaking the granules with calcium stearate by hand for two minutes to blending granules and the calcium stearate in a v-shell blender for ten minutes helped improve fill in the reservoirs. These changes helped somewhat but did not solve the problem entirely. Furthermore, the addition of 2.0 weight percent calcium stearate lengthened rise time substantially (see, Example VIII and FIG. 10).

TABLE II

Improvements in MRBPS Fill Efficiency by Blending Additional Calcium Stearate with MRBPS Granules as Monitored by the Pellet Weight Method.

| | 0.5% Calcium Stearate (hand blended) | 2.0% Calcium Stearate (hand blended) | 2.0% Calcium Stearate (v-shell blended) |
|---|---|---|---|
| Weight (grams) | 0.184 | 0.189 | 0.191 |
| Height (inches) | 0.218 | 0.219 | 0.221 |
| Density (g/cc) | 1.683 | 1.711 | 1.716 |

Example X(b)

Granulation of Moist MRBPS Prills Followed by Drying and Grinding

Experiments 1A–1C in Table III summarizes efforts to grind pellet feedstock produced by the original process of granulating ethanol-moist prills at three different granule sizes, −14, −20 and −24 mesh. Once granulated and dried, the granules were regranulated through the same mesh screen that was used to granulate them previously. It was assumed the regranulation of the dried granules would smooth rough surfaces and produce a more spherical granule. Using the pellet weight method described hereinabove in Example IX, the more coarsely granulated MRBPS compositions produced pellets with the highest pellet density and also the highest fill density. Smaller mesh sizes tended to extrude the moist prills, producing oblong granules having less fill density. Unfortunately, the granules with the greatest fill density were too large to fit into the die reservoir for the mortar ignition cartridges.

Experiments 1A–1C validate that fill density can be used as a method of determining fill efficiency of the MRBPS granules into the die reservoir since the values for pellet density and pour density agree with each other in Experiments 1A and 1B in Table III.

Experiment 2 in Table III was similar to Experiment 1 except that the dried granules were ground to a smaller mesh size using a Wiley mill. It was assumed that this grinding process would smooth rough surfaces more efficiently and produce a more spherical granule. Indeed, grinding the granules that were originally −20 mesh to −30 and −40 mesh, respectively, did enhance fill efficiency. The −30 mesh sample improved fill efficiency the most.

Experiments 3A1–3A5 in Table III looked at the possibility of using the Stokes granulator instead of the Wiley mill for the granule-grinding step. Fill density of the granules indeed increased if they were ground once they were dry. Fill density increased even if the mesh size was the same as that for the original moist granulation. For an original −14 mesh moist granulation, grinding dry granules smaller than −20 mesh produced no appreciable increase in return for the effort expended.

TABLE III

Summary of Fill Density Studies on MRBPS Pellet Feedstock.
(*Results are from a different MRBPS formulation; the numbers are corrected for density differences, allowing the numbers to be comparable to the other data points in the table.)

| Experiment ID | First Granulation Wet/Dry | First Granulation Mesh Size | Second Granulation Granulating Device | Second Granulation Mesh Size | Fill Density (g/cc) | Pellet Density at Constant Rotary Press Fill Depth (g/cc) |
|---|---|---|---|---|---|---|
| 1A | Wet | 24 mesh | Stokes | 24 mesh | 0.58 | 1.45 |
| 1B | Wet | 20 mesh | Stokes | 20 mesh | 0.62 | 1.51 |
| 1C | Wet | 14 mesh | Stokes | 14 mesh | 0.66 | |
| 2A | Wet | Twice @ 20 mesh | None | NA | 0.60 | |
| 2B | Wet | Twice @ 20 mesh | Wiley | 20 mesh | 0.61 | |
| 2C | Wet | Twice @ 20 mesh | Wiley | 30 mesh | 0.67 | 1.65 |
| 2D | Wet | Twice @ 20 mesh | Wiley | 40 mesh | 0.64 | 1.60 |
| 3A1 | Wet | 14 mesh | None | NA | 0.59 | |
| 3A2 | Wet | 14 mesh | Stokes | 14 mesh | 0.66 | |
| 3A3 | Wet | 14 mesh | Stokes | 20 mesh | 0.69 | |
| 3A4 | Wet | 14 mesh | Stokes | 24 mesh | 0.70 | |
| 3A5 | Wet | 14 mesh | Stokes | 30 mesh | 0.70 | |
| 3B1 | Dry | NA | None | NA | 0.79 | |
| 3B2 | Dry | NA | Stokes | 14 mesh | 0.80 | |
| 3B3 | Dry | NA | Stokes | 20 mesh | 0.79 | 1.72* |
| 3B4 | Dry | NA | Stokes | 24 mesh | 0.77 | 1.70* |
| 3C1 | MRBPS | Ground Pellets | Wiley | 30 mesh | 0.82 | 1.79 |

Example X(c)

Drying Prilled MRBPS Before Grinding

When the overall process for producing pellet feedstock was modified by drying the Hobart mixer-produced prills before granulation, feedstock with the highest fill density was produced (see,Experiments 3B1–3B4 in Table III). Unground, dried prills have fill densities comparable to ground prills. Unfortunately, the prill size is too coarse for feeding into mortar ignition cartridge pellet dies (see, FIG. 8); thus, a grinding step is necessary. Optimal pour density for mortar ignition cartridge feedstock produced in this manner was determined to be −20 mesh.

Figure 12:
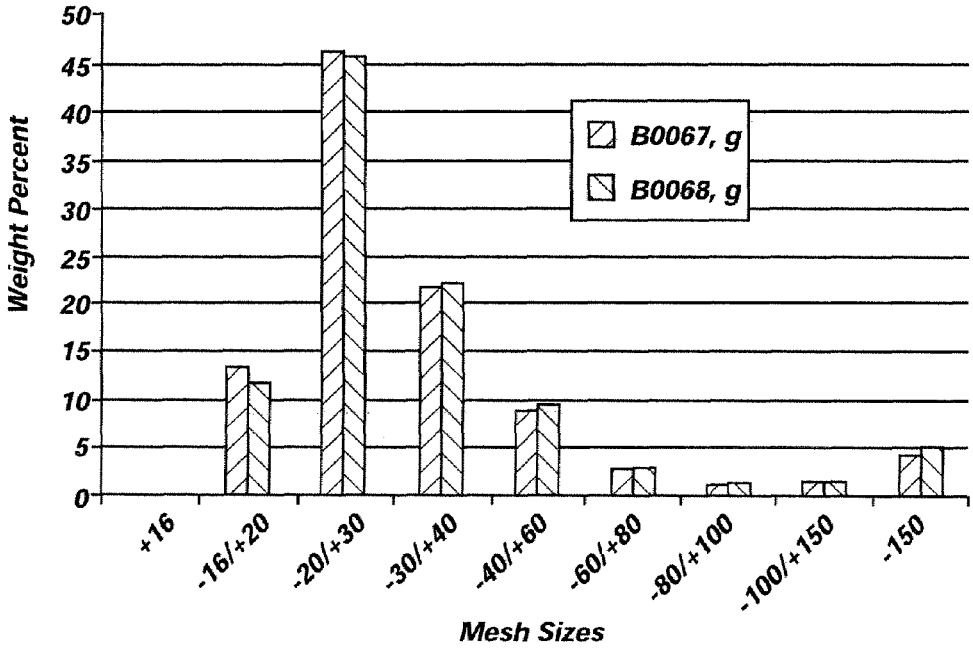
FIG. 12 illustrates the particle size distribution of two separate lots of pellet feedstock dried before granulation, blended with calcium stearate, granulated, and polished for ten minutes after granulation.

It appears that as the prills are formed in the Hobart mixer, voids therein are forced out via the mixing action. The prills tend to be spherical and have smooth surfaces. These properties are conducive to high fill densities. The Stokes granulator destroys the smooth surfaces on the moist granules and produces oblong granules, destroying the fill efficiency of the prills. The Stokes granulator cannot mar the smooth surfaces on the dried, hardened granules. In fact, the fill density of −20 mesh granules in Experiment 3B3 (see, Table III) is not much smaller than that for ground pellets. Particle size distributions for two lots of prills that were dried and then ground to −20 mesh in a Stokes granulator after drying are shown in FIG. 12.

Figure 13:
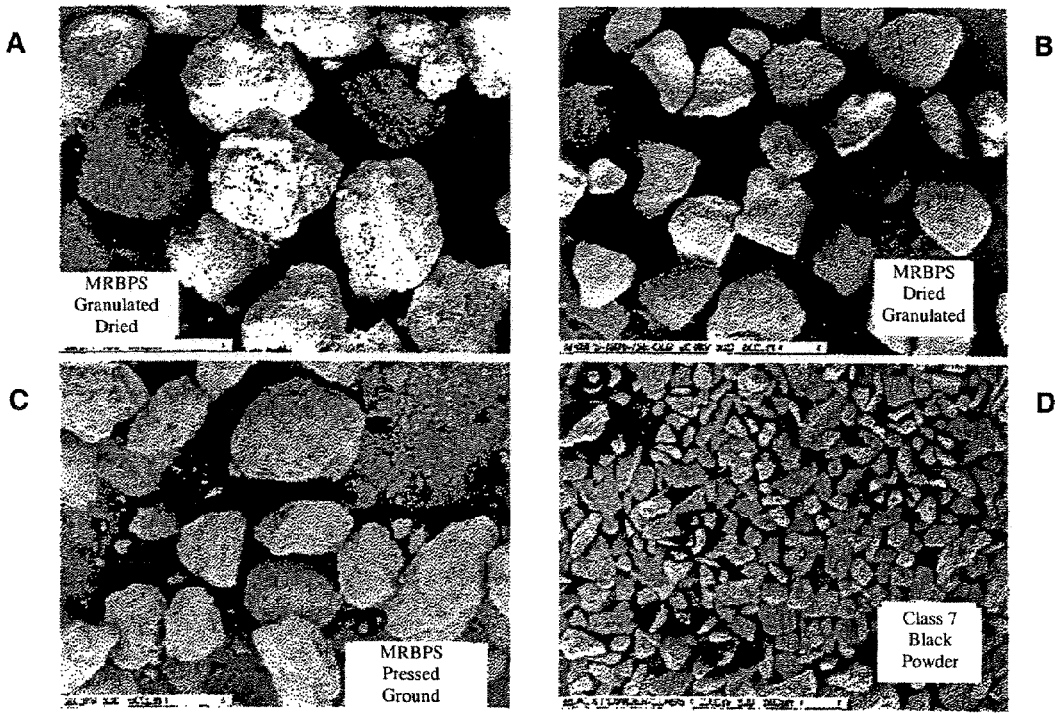
FIG. 13 illustrates three photomicrographs (labeled A–C) of MRBPS granules processed as labeled and compared to Class 7 Black Powder (photomicrograph labeled D).

Micrographs of MRBPS granules (labeled A–C) processed by the various processes discussed above are shown in FIG. 13 and compared to Class 7 Black Powder, i.e., black powder comprising 75% KN, 15% charcoal and 10% sulfur (photomicrograph labeled D). Granules with lower fill densities tend to have rougher surfaces and are more porous.

Selected fill densities were measured on granules of mixes utilized in the ethyl cellulose formulation matrix (two formulations having between about 20.0% and about 30.0% KP, a 1.1 to 1.4 fuel-to-oxidizer ratio and about 3.0% EtCel binder). It is evident from the data in Table IV that the calcium stearate enhances fill density above and beyond what can be achieved by drying prills before granulation.

TABLE IV

MRBPS Fill Densities Before and After Blending with Calcium Stearate Dry Lubricant.

| Formulation | Fill Density (g/cc, before blending with calcium stearate) | Fill Density (g/cc, after blending with 0.5% calcium state in a v-shell blender for 10 minutes) |
|---|---|---|
| 99C | 0.782 | 0.881 |
| 99D | 0.797 | 0.875 |

Process changes have increased the fill density of MRBPS compositions by about 47%. This, in turn, has led to the production of a pellet feedstock that can be used to press high-density pellets. Furthermore, the density of the pellets does not appear to change significantly with time as larger lots of pellets are pressed.

Example XI

Mitigation of Electrostatic Discharge Sensitivity During Pellet Feedstock Production A previously utilized process for producing pellet feedstock from prills dried before granulation went through the steps of drying prills in an oven, granulating the prills to −20 mesh, blending the prills with calcium stearate and pressing the resultant pellets. However, it was determined that the material having the composition labeled 78E that was derived from granulating with a −20 mesh screen was electrostatic discharge (ESD) sensitive (see, formulation 10, Table V). The ESD sensitivity of early samples of MRBPS compositions yielded values greater than 8 Joules (see, formulations 2–4, Table V). Earlier samples containing PVAc as the binder (see, formulations 2–4, Table V) showed no ESD sensitivity. These compositions were granulated wet. When the binder was changed to ethyl cellulose (these materials being granulated from dried prills), hazard sensitivity was determined (see, formulations 5 and 6, Table V). ESD sensitivity increased. The origins of this added sensitivity might have been due to two possible sources: the change in binder to ethyl cellulose and/or granulating the prilled MRBPS at the end of mix after it has dried.

In order to find the best method to alleviate the ESD sensitivity, the MRBPS compositions having formulations 7 through 12 shown in Table V were prepared.

TABLE V

ESD Sensitivity of MRBPS Samples. (*Ten separate ESD measurements were taken for a sample at 8 Joules. If the sample did not ignite, the ESD sensitivity was reported as >8 J. If the material ignited, the energy of the discharge was decreased systematically until the sample did not ignite for 10 straight tests. Thus, when the value is >8 Joules, the reported ESD reading is a compilation of at least 20 data points.)

| No. | Formulation | % KP | Binder | Press Aid | Initial Granulation | TC ESD, Unconfined (Joules)* | Bulk Ignition at 8 Joules |
|---|---|---|---|---|---|---|---|
| 1 | Class 7 Black Powder | | | | | >8 | NT |
| 2 | 97B | 25 | PVAc | None | Wet | >8 | NT |
| 3 | 90C | 30 | PVAc | None | Wet | >8 | NT |
| 4 | 90D | 30 | PVAc | None | Wet | >8 | NT |
| 5 | 99C1 | 30 | EtCel | 0.5% Calcium Stearate | Dry | 0.35 ± 0.71 | Yes |
| 6 | 78E1 | 20 | EtCel | 0.5% Calcium Stearate | Dry | 7.79 ± 0.11 | No |
| 7 | 78C | 20 | PVAc | None | Dry | 7.50 ± 0.01 | Yes on 7th Bulk Shot |
| 8 | 78C1 | 20 | PVAc | 0.5% Calcium Stearate | Dry | 7.06 ± 0.47 | Yes on 4th Bulk Shot |
| 9 | 78C4 | 20 | PVAc | 0.5% Graphite | Dry | >8 | NT |
| 10 | 78E | 20 | EtCel | None | Dry | 6.83 ± 0.96 | Yes on 4th Bulk Shot |
| 11 | 78E1 | 20 | EtCel | 0.5% Calcium Stearate | Dry | >8 | NT |
| 12 | 78E4 | 20 | EtCel | 0.5% Graphite | Dry | >8 | NT |

The formulation for the compositions labeled 78C and 78E were described hereinabove. The formulation for the composition labeled 97B contained about 2.0% binder and about 25.0% KP, and had a 1.4 fuel-to-oxidizer ratio. The formulations for the compositions labeled 90C and 99C1 contained about 3.0% binder and 30.0% KP, and had a 1.4 fuel-to-oxidizer ratio. The formulation for the composition labeled 90D contained about 3.0% binder and 30.0% KP, and had a 1.1 fuel-to-oxidizer ratio.

The data for the blended compositions labeled 78C (see, formulations 7 and 8, Table V) suggests that the binder change is not the source of ESD sensitivity since these blends contain PVAc binder. The unblended composition labeled 78C show ESD sensitivity as does the composition 78C1, which is blended with calcium stearate. Thus, the source of ESD sensitivity appears to be due to granulating the prilled MRBPS after it is dried. Granulating by this method is necessary to increase the fill density of the MRBPS granules. While not being held to any one theory, the inventors hereof believe that granulating the dry material may produce sharp edges causing the granules to be more sensitive to ESD.

The blended compositions labeled 78E1, 78E4 which are blended with a dry lubricant (see, formulations 11 and 12 Table V), show no ESD sensitivity whereas the unblended material shows ESD sensitivity. It is, accordingly, evident that blending MRBPS with a process aid is necessary to decrease ESD sensitivity.

Measured fill densities (see, Table VI) for the blends with calcium stearate were somewhat higher than those for graphite. The MRBPS compositions comprising EtCel as a binder exhibited higher fill densities. Furthermore, the pellets made from the graphite blends did not release readily from the dies. As the punches moved upward to push the pellets out of the dies, the pressing table moved upward also. This placed too much stress on the rotary press. An additional 0.5 weight percent graphite was added to the graphite blends, but this did not solve the pellet release problem. Although graphite may mitigate ESD sensitivity, it is ineffective as a press release aid. The ballistic data in FIG. 11, measured using the Primer Bomb method (as described in Example II, above), illustrate that there is no apparent ballistic advantage to using graphite over calcium stearate.

In summary, the currently preferred process for producing granular pellet feedstock comprises adding 0.5 weight percent calcium stearate to dried prills before granulation. In practice, the process comprises drying the prills in an oven, blending the prills with 0.5 weight percent calcium stearate, granulating the prills (−20 mesh), optionally re-blending the granules in the v-shell blender to polish the granules and further enhance bulk density, and pressing the granules into pellets. This process appears to mitigate ESD hazards relative to a process wherein the order of the blending and granulating steps is reversed.

TABLE VI

Fill Densities of MRBPS Formulations Blended with Process Aid.

| Blend ID | 78C1 | 78C4 | 78E1 | 78E4 |
|---|---|---|---|---|
| Blend Lot | B0055 | B0056 | B0053 | B0054 |
| Process Aid | 0.5% Calcium Stearate | 0.5% Graphite | 0.5% Calcium Stearate | 0.5% Graphite |
| Binder | 3.0% PVAc | 3.0% PVAc | 3.0% EtCel | 3.0% EtCel |
| Fill Density (g/cc) | 0.860 | 0.824 | 0.887 | 0.844 |

Example XII

Pellet Density Refinement

Figure 15:
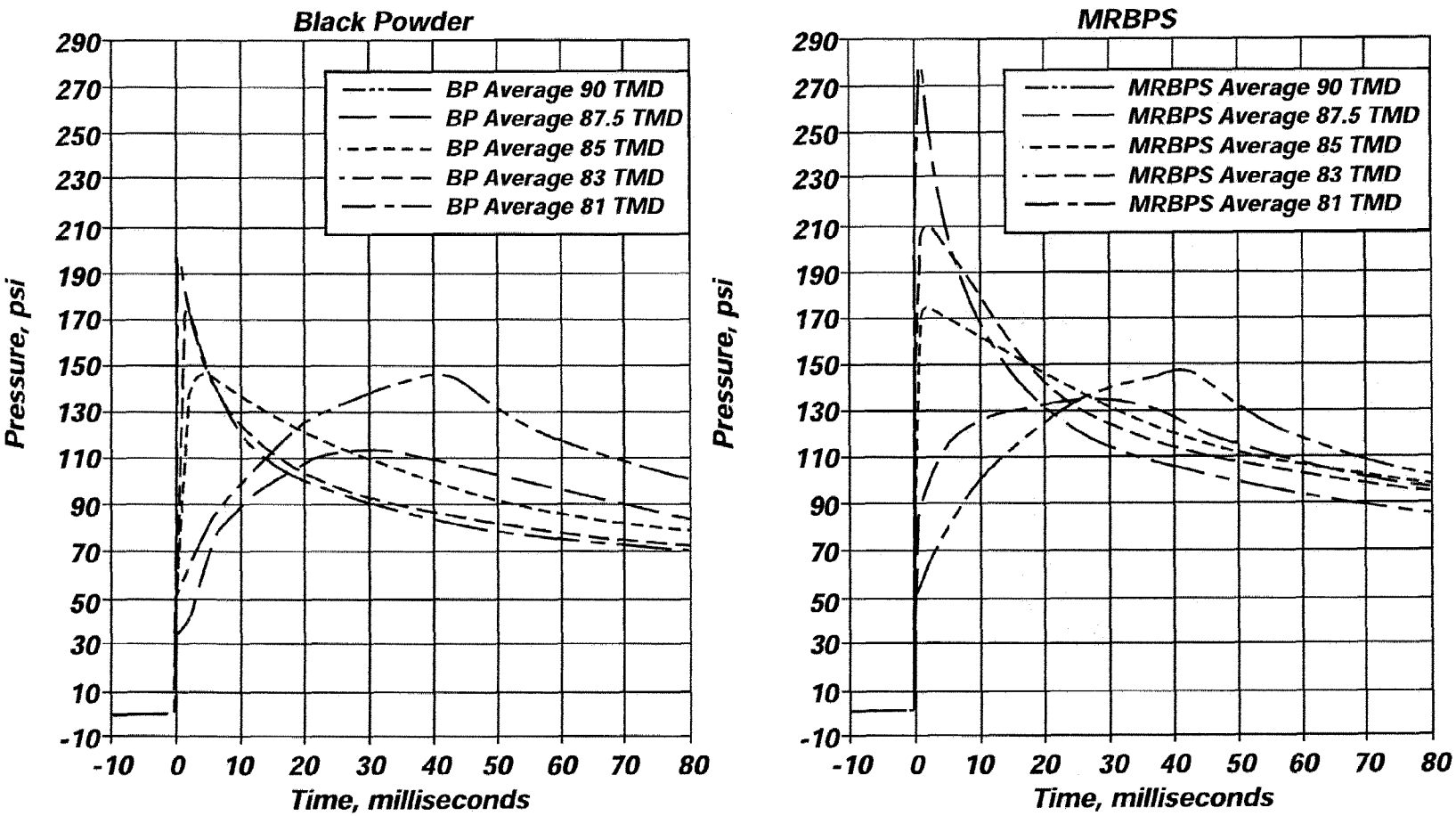
FIG. 15 illustrates the average ballistic response using the Primer Bomb method of mortar ignition cartridge pellets (black powder and MRBPS) as a function of pellet density. As is evident, ballistic response of pelletized black powder and MRBPS is highly dependent on the density of the pellets. ("TMD" indicates theoretical maximum density.)

It is noted that the ballistic response of pelletized black powder and MRBPS is highly dependent on the density of pellets (see, FIG. 15). This is especially true at moderate pellet densities (e.g., 87.5 percent of theoretical maximum density (%TMD) and 85% TMD for both black powder and MRBPS in FIG. 15). At high densities (e.g., 90% TMD for both black powder and MRBPS in FIG. 15), pellets combust on the outer surface, whereas at lower densities (e.g., 83% TMD and 81% TMD for both black powder and MRBPS in FIG. 15), pellets may be pulverized, for example, by the shock wave of the primary explosive in a primer. Thus, these pellets may behave ballistically as if they have the surface area of granules with the added advantage of 50% greater bulk density, i.e., 50% more pyrotechnic can fit in the same volume, which can be very significant in volume-limited applications. It is therefore, advantageous, in certain applications, to design the pellets to have either a high pellet density, and thus undergo combustion consistently via the surface burning mechanism, or a low pellet density and burn via ignition-train promoted pulverization. Pellets pressed at moderate densities exhibit a varied ballistic response due to inconsistency in the manner of pellet breakup from pellet to pellet. High-density pellets may have special utility as delay charges or where a slow, steady ballistic response is required. Low-density pellets, on the other hand, may have special utility in ignition trains where rapid ballistic response is vital.

Example XIII

Granular Density

Densities of Class 7 Black Powder and MRBPS comprising various compositions are summarized in Table VII.

TABLE VII

Bulk Densities (Fill and Vibrated) for Class 7 Black Powder and Various MRBPS Samples.

| Experiment Number | Type | Sample | Lot Number | Granule Type | Number of Tests | Average (g/cc) | Standard Deviation (g/cc) |
|---|---|---|---|---|---|---|---|
| 1 | Fill | MRBPS | B0069 | Feedstock | 25 | 0.833 | 0.009 |
| 2 | Fill | MRBPS | B0067 | Feedstock | 5 | 0.858 | 0.012 |
| 3 | Fill | MRBPS | B0068 | Feedstock | 5 | 0.858 | 0.014 |
| 4 | Fill | BP | Goex | Class 7 Granules −16/+40 mesh | 5 | 0.878 | 0.014 |
| 5 | Vibrated | MRBPS | B0067 | Feedstock | 5 | 1.042 | 0.007 |
| 6 | Vibrated | MRBPS | B0068 | Feedstock | 5 | 1.042 | 0.009 |
| 7 | Vibrated | BP | Goex | Class 7 Granules −16/+40 mesh | 5 | 1.089 | 0.012 |
| 8 | Vibrate | MRBPS | B0067 | −8/+16 mesh Ground Pellets | 5 | 0.975 | 0.007 |
| 9 | Vibrated | MRBPS | B0068 | −8/+16 mesh Ground Pellets | 5 | 0.974 | 0.005 |
| 10 | Vibrated | MRBPS | M0052 | −8/+16 mesh Dried Prills | 1 | 0.914 | NA |
| 11 | Vibrated | MRBPS | M0053 | −8/+16 mesh Dried Prills | 1 | 0.935 | NA |
| 12 | Vibrated | MRBPS | B0067 | −16/+40 mesh Ground Pellets | 5 | 0.998 | 0.004 |
| 13 | Vibrated | MRBPS | B0068 | −16/+40 mesh Ground Pellets | 5 | 1.000 | 0.002 |
| 14 | Vibrated | MRBPS | B0067 | −16/+40 mesh Classified Feedstock | 2 | 0.963 | 0.001 |
| 15 | Vibrated | MRBPS | B0068 | −16/+40 mesh Classified Feedstock | 3 | 0.952 | 0.004 |
| 16 | Vibrated | MRBPS | M0053 | −16/+40 mesh Dried Prills | 1 | 0.945 | NA |
| 17 | Vibrated | MRBPS | B0067 | −40/+100 mesh Ground Pellets | 5 | 0.962 | 0.008 |
| 18 | Vibrated | MRBPS | B0068 | −40/+100 mesh Ground Pellets | 5 | 0.955 | 0.009 |
| 19 | Vibrated | MRBPS | B0067 | −40/+100 mesh Classified Feedstock | 1 | 0.898 | NA |
| 20 | Vibrated | MRBPS | B0068 | −40/+100 mesh Classified Feedstock | 1 | 0.908 | NA |

Experiments 1 through 4 are fill density measurements. This test sheds light on the behavior of granules as they fill the die reservoirs on the rotary press. Experiment 1 was conducted on an MRBPS blend in which dried prills were blended with calcium stearate for 10 minutes before granulation. Experiments 2 and 3 were conducted on the deliverable lots. These granules experienced the same processing as those in Experiment 1 and were blended for an additional 10 minutes in the v-shell blender after granulation. The additional blending time appears to improve the fill density of the MRBPS compositions by about 3.0%.

It was found that vibration of the pellet feedstock increased the bulk density by over 20% (Experiments 5 and 6 relative to Experiments 2 and 3). Vibrated bulk density is a useful parameter for determining the maximum weight of granules that can fit in a specified volume which is important in designing pyrotechnic devices. It is noteworthy that the MRBPS pellet feedstock had a higher vibrated bulk density (1.042 g/cc in Experiments 5 and 6) than any of its component particle size distributions, −16/+40 mesh (0.949 g/cc—average of Experiments 14 and 15) and−40/+100 mesh (0.903 g/cc—average of Experiments 19 and 20). The unclassified MRBPS pellet feedstock had a broader particle size distribution; granules as coarse as −16 mesh and finer than +150 mesh were present in the feedstock. The smaller particles filled the interstices between the larger particles, causing a more efficient use of a given volume.

As opposed to MRBPS pellet feedstock, Class 7 Black Powder had a limited particle size distribution, −40/+100 mesh. Because of this difference in the breadth of their particle size distributions, the fill density of the MRBPS pellet feedstock (see, Table VII, Experiments 2 and 3) is higher in % theoretical maximum density than that for black powder (see, Table VII, Experiment 4): 46% vs. 44%. This is noteworthy, especially since the latter granules are densified, whereas the former are not.

The bulk density of the pellet feedstock may be significantly improved by drying prills of the MRBPS compositions prior to granulation. Granules derived from ground pellets have a vibrated bulk density that is approximately 5% higher than pellet feedstock classified to the same particle size distribution (see, Table VII, Experiments 8 through 20).

It would be significantly more cost efficient to produce MRBPS compositions from pellet feedstock instead of ground pellets for pyrotechnic devices requiring granules. The process for producing MRBPS prills tends to be very reproducible both in the mixing time required to produce them and the amount of residual solvent present with them at the end of mix. Because of this, performance of granules derived directly from these prills should exhibit minimal ballistic variability from lot to lot. Since the current MRBPS baseline in the form of ground pellets produces higher maximum pressures than black powder, using MRPBS compositions with a slightly lower mass load per specified volume may, in fact, be desirable for some applications. If the rise times of the more porous compositions of MRBPS are too short, oxidizer particle size may be increased (potentially decreasing manufacturing cost), fuel content may be decreased (potentially promoting more efficient combustion) and/or the amount of potassium perchlorate in the formulation may be lowered (potentially decreasing actual or perceived hazard potential).

In summary, a number of advantages may be achieved by MRBPS compositions processed according to the methods of the present invention. First, by selecting ethyl cellulose as the binder, ethanol may be used as the processing solvent. Ethanol has a lower flash point than ethyl acetate (the solvent used if poly(vinyl acetate) is utilized as the binder) and less solvent is required to produce well-mixed MRBPS compositions in a prilled state.

A second advantage of processing MRBPS compositions according to the methods of the present invention is that dry blending the finely divided ethyl cellulose and phenolphthalein is advantageous since it eliminates the time-consuming predissolving step. Furthermore, the amount of binder added to the mix is exact and reproducible (no binder/solvent is left as a sticky syrup on the surface of the container in which the premix was produced). In addition, dispersing the binder in the fuel prevents heterogeneous clumps when solvent is added.

A still further benefit of processing MRBPS compositions according to the methods of the present invention is that a binder level of 3.0 weight percent (as opposed to 2.0 weight percent) causes the MRBPS compositions in ethanol to have a higher viscosity. This promotes high-shear mixing that, in turn, produces homogenous MRBPS compositions that exhibit reproducible ballistic performance. The higher binder level enhances the quality and reproducibility of the moist prills of MRBPS produced upon evaporative mixing in a Hobart mixer. Even higher binder levels, e.g., 4.0 weight percent, decrease ballistic performance in that rise times are longer.

Still further, another benefit of producing MRBPS compositions according to the methods of the present invention is that by drying the prills before granulation, the fill density of the resulting granules is increased by about 35% relative to granules produced via granulation of ethanol-moist prills. This improves considerably the feeding of the granules on the rotary press during pellet production. The vibrated bulk density of the granules is about 96% of granules produced by milling pressed MRBPS compositions. The granules derived from prills may be used directly in an application for granular black powder without the added steps of pressing and then milling the MRBPS compositions. This allows for potentially significant decreases in labor costs.

Additionally, due to the blending of calcium stearate, a dry lubricant, with MRBPS compositions, pellets release from the dies of the rotary press without the use of excessive force. The addition of calcium stearate to MRBPS compositions also improves the fill density of the granular pellet feedstock, an added advantage.

Still further, blending calcium stearate with dried prills before granulation reduces the ESD sensitivity of granules produced thereby. Granulation of the prills is necessary to produce particles of pellet feedstock sufficiently small to feed into the dies on the rotary press.

Further still, by pressing pellets to either a high density or to a low density, ballistic response in various applications may be more reproducible since pellets will either combust exclusively via surface burning or ignition train-promoted pulverization to yield a high-surface-area, rapidly deflagrating powder. Low-density pellets that can be pulverized by the shock wave from the ignition train have an advantage over granules in that the bulk density of such pellets is considerably higher than granules of the same composition such that a greater mass of the composition in the form of a pellet may be housed in a fixed volume.

The present invention has been described in relation to particular embodiments that are intended in all respects to be illustrative rather than restrictive. It is to be understood that the invention defined by the appended claims is not to be limited by particular details set forth in the above description and that other and further embodiments will become apparent to those of ordinary skill in the art to which the present invention pertains without departing from the spirit and scope thereof.

What is claimed is:

1. A solid pyrotechnic composition consisting of:

oxidizer particles comprising between about 40.0 weight percent and about 90.0 weight percent of a total weight of a solid pyrotechnic composition;

organic crystalline particles comprising between about 10.0 weight percent and about 60.0 weight percent of the total weight of the solid pyrotechnic composition, wherein the organic crystalline particles comprise at least one organic crystalline compound or a mixture of the at least one organic crystalline compound and at least one salt of the at least one organic crystalline compound, wherein the at least one organic crystalline compound is selected from the group consisting of phenolphthalein and an organic crystalline compound derived from a reaction between a phenolic compound and phthalic anhydride;

ethyl cellulose comprising between about 2.0 weight percent and about 10.0 weight percent of the total weight of the solid pyrotechnic composition; and a dry lubricant comprising between about 0.5 weight percent and about 2.0 weight percent of the total weight of the solid pyrotechnic composition.

2. The solid pyrotechnic composition of claim 1, wherein the oxidizer particles have a mean particle size of not greater than about 30 microns.

3. The solid pyrotechnic composition of claim 1, wherein the oxidizer particles have a mean particle size ranging from about 5 microns to about−20 microns.

4. The solid pyrotechnic composition of claim 1, wherein the oxidizer particles comprise between about 65.0 weight percent and about 80.0 weight percent of the total weight of the solid pyrotechnic composition.

5. The solid pyrotechnic composition of claim 1, wherein the oxidizer particles comprise at least one member selected from the group consisting of an alkali metal nitrate and ammonium nitrate and at least one member selected from the group consisting of an alkali metal perchlorate and ammonium perchlorate.

6. The solid pyrotechnic composition of claim 5, wherein the at least one member selected from the group consisting of an alkali metal perchlorate and ammonium perchlorate comprises between about 0.5 weight percent and about 30.0 weight percent of the total weight of the solid pyrotechnic composition.

7. The solid pyrotechnic composition of claim 5, wherein the at least one member selected from the group consisting of an alkali metal perchlorate and ammonium perchlorate comprises between about 5.0 weight percent and about 20.0 weight percent of the total weight of the solid pyrotechnic composition.

8. The solid pyrotechnic composition of claim 5, wherein the oxidizer particles comprise potassium perchlorate.

9. The solid pyrotechnic composition of claim 5, wherein the oxidizer particles comprise potassium nitrate.

10. The solid pyrotechnic composition of claim 9, wherein the potassium nitrate comprises from about 5.0 weight percent to about 20.0 weight percent of the total weight of the solid pyrotechnic composition.

11. The solid pyrotechnic composition of claim 1, wherein the organic crystalline particles comprise phenolphthalein.

12. The solid pyrotechnic composition of claim 11, wherein phenolphalein comprises between about 13.0 weight percent and about 22.0 weight percent of the total weight of the solid pyrotechnic composition.

13. The solid pyrotechnic composition of claim 1, wherein the organic crystalline particles and the one or more salts of the organic crystalline particles have a mean particle size not greater than about 30 microns.

14. The solid pyrotechnic composition of claim 1, wherein the organic crystalline particles have a mean particle size not greater than about 15 microns.

15. The solid pyrotechnic composition of claim 1, wherein a weight ratio of the at least one organic crystalline compound to the at least one salt of the at least one organic crystalline compound is at least 80:20.

16. The solid pyrotechnic composition of claim 1, wherein the ethyl cellulose comprises about 3.0 weight percent of the total weight of the solid pyrotechnic composition.

17. The solid pyrotechnic composition of claim 1, wherein the solid pyrotechnic composition is substantially free of sulfur and charcoal.

18. The solid pyrotechnic composition of claim 1, wherein the solid pyrotechnic composition is substantially free of boron.

19. The solid pyrotechnic composition of claim 1, wherein the solid pyrotechnic composition has a moisture uptake of not greater than 0.25 weight percent at 75.0 percent relative humidity at a temperature of 21.1° C. over a period of 24 hours.

20. The solid pyrotechnic composition of claim 1, wherein the solid pyrotechnic composition is formulated to have, upon ignition, a theoretical flame temperature not greater than about 2300K.

21. The solid pyrotechnic composition of claim 1, wherein the solid pyrotechnic composition is formulated to have, upon ignition, a theoretical flame temperature between about 1750K and 2300K.

22. The solid pyrotechnic composition of claim 1, wherein the oxidizer particles comprise potassium nitrate.

23. The solid pyrotechnic composition of claim 1, wherein the oxidizer particles comprise potassium perchlorate.

24. The solid pyrotechnic composition of claim 1, wherein the dry lubricant comprises calcium stearate or graphite.

* * * * *